US007389625B2

(12) United States Patent
Nakagawa et al.

(10) Patent No.: US 7,389,625 B2
(45) Date of Patent: Jun. 24, 2008

(54) PACKAGING APPARATUS AND PACKAGING SYSTEM INCLUDING THE SAME

(75) Inventors: Yukio Nakagawa, Kyoto (JP); Yoshio Iwasaki, Kusatsu (JP); Taro Hijikata, Otsu (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 11/336,946

(22) Filed: Jan. 23, 2006

(65) Prior Publication Data

US 2006/0162284 A1 Jul. 27, 2006

(30) Foreign Application Priority Data

Jan. 24, 2005 (JP) ..... 2005-015881

(51) Int. Cl.
*B65B 41/12* (2006.01)
*B65H 19/12* (2006.01)

(52) U.S. Cl. ..... 53/389.2; 242/533.7; 242/559; 242/559.3; 242/559.4

(58) Field of Classification Search ..... 242/533.7, 242/559, 559.3, 559.4; 53/389.2; *B65B 41/12; B65H 19/12*

See application file for complete search history.

(56) References Cited

U.S. PATENT DOCUMENTS 3,042,335 A * 7/1962 Ensign et al. ..... 242/532.6
3,718,302 A * 2/1973 Mount et al. ..... 242/533.3
3,847,366 A * 11/1974 Schmidt et al. ..... 242/533.7
4,840,321 A 6/1989 Focke et al.
4,896,842 A 1/1990 Heinz et al.
5,031,381 A 7/1991 Focke
5,205,505 A 4/1993 Focke et al.
5,274,984 A * 1/1994 Fukuda ..... 242/559.3
5,531,398 A * 7/1996 Krska ..... 242/533.7
6,604,704 B2 * 8/2003 Kiprowski ..... 242/559.1
2001/0045490 A1 11/2001 Kiprowski

FOREIGN PATENT DOCUMENTS

JP 3-129206 U 12/1991
JP 5-97124 A 4/1993
JP 7-002547 B2 1/1995
JP 8-009441 B2 1/1996

* cited by examiner

*Primary Examiner*—Stephen F Gerrity
(74) *Attorney, Agent, or Firm*—Global IP Counselors, LLP

(57) ABSTRACT

A packaging apparatus includes a support unit having a first support shaft with a first open end portion, the first support shaft being adapted to rotatably support the film roll in a cantilevered manner; a packaging unit adapted to receive the film of the film roll supported by the support unit, the bag packaging unit being adapted to package items with the film; and a temporary holding unit. The temporary holding unit has a second support shaft that has a second open end portion, the second support shaft being adapted to support the film roll in a cantilevered manner, and a movement mechanism configured to controllably pass the film roll from the second support shaft to the first support shaft when the first open end portion of the first support shaft and the second open end portion of the second support shaft are substantially aligned.

17 Claims, 15 Drawing Sheets

PACKAGING APPARATUS AND PACKAGING SYSTEM INCLUDING THE SAME

BACKGROUND OF THE INVENTION

1. Field of the Invention

The present invention relates to a packaging apparatus that supplies a film to a packaging unit, which package products using the film while rotating a film roll to supply the film therefrom. The present invention also relates to a packaging system including such packaging apparatus.

2. Background Information

Film rolls in packaging apparatuses are generally replaced by temporarily stopping the operation of the apparatus, manually removing the paper tube (core) of the finished film roll, and then mounting a new film roll. However, the operation of replacing the film roll has been hard work and has imposed a significant burden on the operator, because normally almost 1000 m of the film roll is wound around the paper tube, and the roll therefore weighs up to several dozen kilograms. Furthermore, since the operation of the apparatus is stopped while the film roll is replaced, the replacement is preferably completed efficiently in the shortest possible amount of time.

In view of this, packaging apparatuses have been conceived which automatically replace film rolls in this manner with a machinery. However, such packaging apparatuses described above have the following problems.

Specifically, since these packaging apparatuses described above have a double-end supporting configuration in which the film roll is supported at both sides of the axis of rotation, a new film roll must be mounted from a direction perpendicular to the axis of rotation. Therefore, a complicated structure is needed that supports the film roll. As a result, the mechanism is complicated, which prolongs the time required for replacement of film rolls.

In view of the above, it will be apparent to those skilled in the art from this disclosure that there exists a need for an improved package machine that addresses the above discussed problem. This invention addresses this need in the art as well as other needs, which will become apparent to those skilled in the art from this disclosure.

SUMMARY OF THE INVENTION

The present invention provides a packaging apparatus for a packaging apparatus wherein a film roll can be loaded efficiently with a simple configuration, and a packaging system that includes such packaging apparatus.

The packaging apparatus according to a first aspect includes a support unit having a first support shaft with a first open end portion in one end, the first support shaft being adapted to rotatably support the film roll in a cantilevered manner; a packaging unit adapted to receive the film of the film roll supported by the support unit, the bag packaging unit being adapted to package items with the film; and a temporary holding unit. The temporary holding unit has a second support shaft that has a second open end portion in one end, the second support shaft being adapted to support the film roll in a cantilevered manner, and a movement mechanism configured to controllably pass the film roll from the second support shaft to the first support shaft when the first open end portion of the first support shaft and the second open end portion of the second support shaft are substantially aligned.

In this packaging apparatus, a film roll can be loaded onto the first support shaft, which supports the film roll in a cantilevered manner, with a temporary holding unit that has a second support shaft for temporarily supporting the film roll in a cantilevered manner thereby conveying the film roll from a stocking location or the like. When the open ends of the first and second support shafts face each other, the first and second support shafts coaxially lie on a substantially straight line while the film roll is supported in cantilevered manner by the second support shaft. The movement mechanism of the temporary holding unit then moves the film roll to the second open-end side of the first support shaft, and passes the film roll to the first support shaft, which is on a substantially straight line relative to the second support shaft.

The film roll can thereby be loaded onto the cantilever-supporting first support shaft in a smooth manner from the open-end side of the first support shaft. As a result, it is possible to load the desired film roll more efficiently than a case where packaging the film roll is supported at both ends, for example.

The packaging apparatus according to a second aspect is the packaging apparatus according to the first aspect, wherein the movement mechanism has a plate member movably mounted on the second support shaft, and a drive mechanism configured to controllably move the plate member toward and away from the second open end portion relative to the second support shaft.

In this aspect, the plate member mounted on the end portion of the second support shaft on the opposite side of the second open end is herein moved toward the second open end, whereby the film roll is transferred from the second support shaft to the first support shaft.

The configuration of the movement mechanism can thereby be simplified by moving the plate member by an air cylinder or another such drive mechanism, for example.

The packaging apparatus according to a third aspect is the packaging apparatus according to the second aspect, wherein the drive mechanism is configured to controllably move the plate member away from the second open end portion after the movement mechanism passes the film roll to the first support shaft.

In this aspect, after the replacement film roll is moved to the first support shaft, the plate member returns to the original position and the temporary holding unit waits in a position for receiving another replacement film roll.

The subsequently loaded film roll can thereby be received immediately, and the next loading cycle can be performed efficiently.

The packaging apparatus according to a fourth aspect is the packaging apparatus according to any one of the first through third aspects, wherein the support unit further has a removing mechanism configured to controllably move the film roll toward the first open end portion relative to the first support shaft.

In this aspect, when the film from the film roll is all used up, the core member around which the film had been wound can be removed from the first open-end side of the first support shaft with the removing mechanism of the support unit.

Thereby, when all the film from the film roll has been used up, the first support shaft can be prepared to allow a new film roll to be mounted by first removing the core from the first support shaft. As a result, a new film roll can be immediately loaded onto the first support shaft by the aforementioned temporary holding unit.

The packaging apparatus according to a fifth aspect is the packaging apparatus according to the fourth aspect, wherein the removing mechanism includes a plate member movably mounted to the first support shaft, and a drive mechanism configured to controllably move the plate member toward and away from the first open end portion relative to the first support shaft.

In this aspect, the plate member provided on the opposite side of the first open end of the first support shaft is moved to the first open-end side relative to the first support shaft, whereby the core is removed from the first support shaft.

The configuration of this removing mechanism can be simplified by moving the plate member with an air cylinder or another such drive mechanism, for example.

The packaging apparatus according to a sixth aspect is the packaging apparatus according to the fifth aspect wherein, the removing mechanism includes a plate member movably mounted to the first support, and a drive mechanism configured to controllably move the plate member toward and away from the first open end portion relative to the first support shaft.

In this aspect, the core of the film roll removed from the first support shaft is received by the second support shaft of the temporary holding unit via the open ends and is conveyed to a disposal position.

The temporary holding unit can thereby dispose of the core received from the first support shaft by moving the plate member to the second open-end side of the second support shaft in a disposal location. The temporary holding unit can thereby be used during the core disposal as well as the film roll mounting. Furthermore, conveying the core to a disposal location makes it possible to avoid troubles of the cores scattering in the area around the packaging apparatus and other such problems.

The packaging apparatus according to a seventh aspect is the packaging apparatus according to any one of the first through sixth aspects, wherein the packaging apparatus has only one support unit.

In this aspect, the packaging apparatus retains only one film roll at a time. Since the packaging apparatus of the present invention can load a film roll in an efficient manner as discussed above, there is no need to retain more than one film roll at a time. Thus, it is possible to reduce the size of and simplify the structure of the packaging apparatus.

The packaging apparatus according to an eighth aspect is the packaging apparatus according to any one of the first through seventh aspects, further comprising a pawl member that is configured to controllably move to a position adjacent to a surface of the film roll such that the pawl member engages and picks up an end of the film of the film roll supported by the first support shaft.

In this aspect, the pawl member disposed near the film surface of the film roll is used to pick up the end of the film wound around the film roll after a new film roll is loaded.

Rotating the film roll thereby makes it possible to pick up the end of the film with the pawl member, which is disposed near the film, and to lift up and easily unroll the end of the film from the film roll.

A resin or the like having good slip properties is preferably used as the material of the pawl member. It is thereby possible to reduce the occurrence of problems of the film being damaged when the pawl member comes in contact with the film roll.

The packaging apparatus according to a ninth aspect is the packaging apparatus according to the eighth aspect further comprising a film conveying unit configured to controllably convey the end of the film picked up from the film roll by the pawl member, and a splicer to which the film conveying unit conveys the end of the film, the splicer being configured to splice the end of the film of the film roll supported by the first support shaft and an end of a film of another film roll.

In this aspect, the end of the film unrolled from the film roll is conveyed to the splicer of the packaging apparatus by the film conveying unit.

The end of the film picked up from the film roll by the pawl member is thereby directly conveyed to the splicer for forming the joints between films, whereby the operation of the packaging apparatus can be immediately initiated. A pair of rollers or the like that convey the film sandwiching the film therebetween can be used as the film conveying unit.

The packaging system according to a tenth aspect comprises the packaging apparatus according to any one of the first through ninth aspects, and a packaging unit adapted to receive the film of the film roll supported by the support unit of the packaging apparatus, the bag packaging unit being adapted to package items with the film.

In this aspect, the packaging system is assembled wherein film rolls for replacement are conveyed to the packaging apparatuses by a conveying mechanism for conveying film rolls to be used in the packaging apparatuses from, for example, a stocking location or the like where film rolls are stored.

With the packaging apparatus of the present invention, it is possible to load a desired film roll in a more effective manner than with a packaging apparatus in which the film roll is supported at both ends.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The bag manufacturing packaging apparatus (packaging apparatus) according to one embodiment of the present invention is described below, with reference to FIGS. 1 through 12B.

<Configuration of Bag Manufacturing Packaging Apparatus 3>

Figure 1:
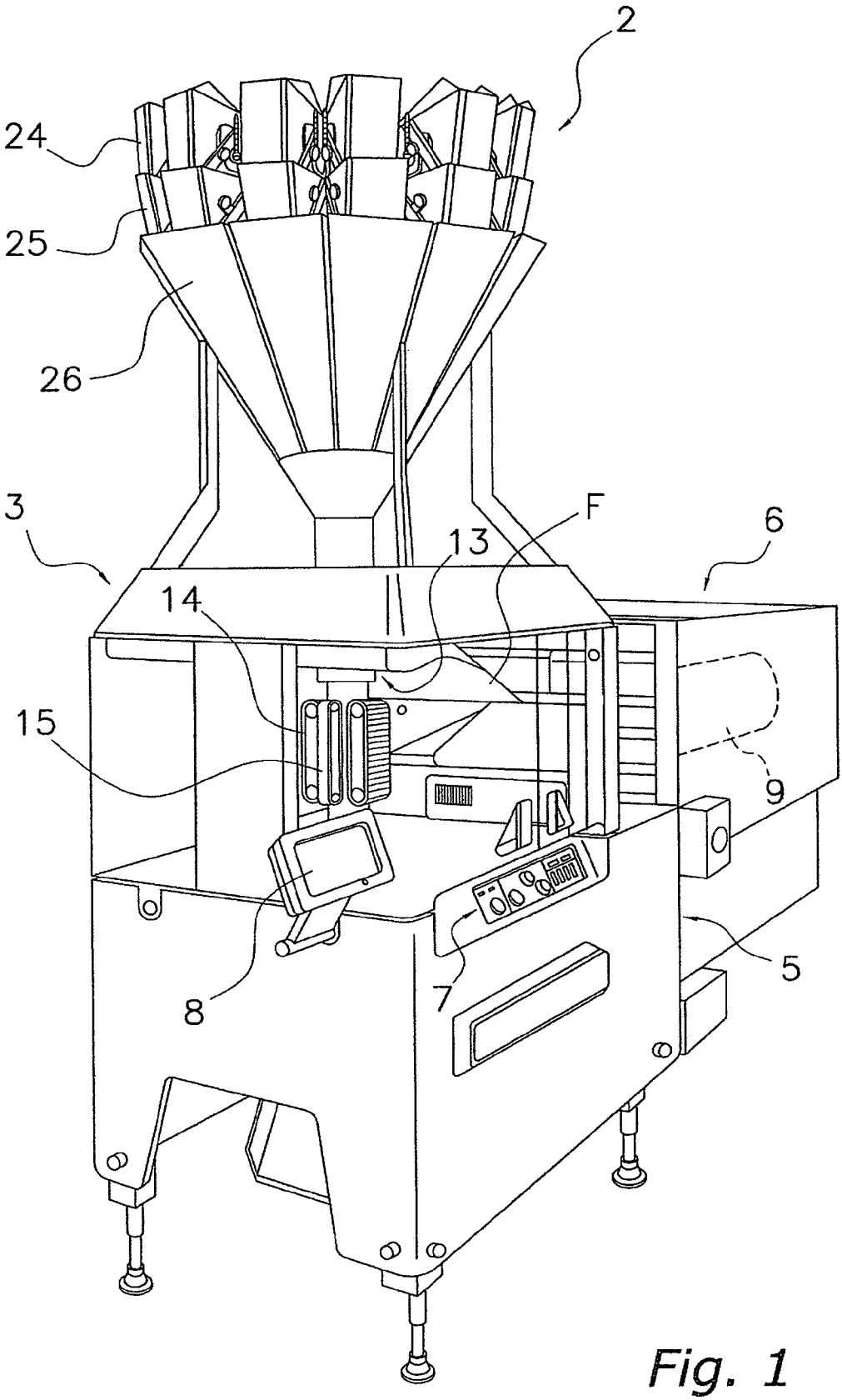
FIG. 1 is a schematic perspective view of a bag manufacturing packaging apparatus with a weighing machine according to one embodiment of the present invention.
Figure 2:
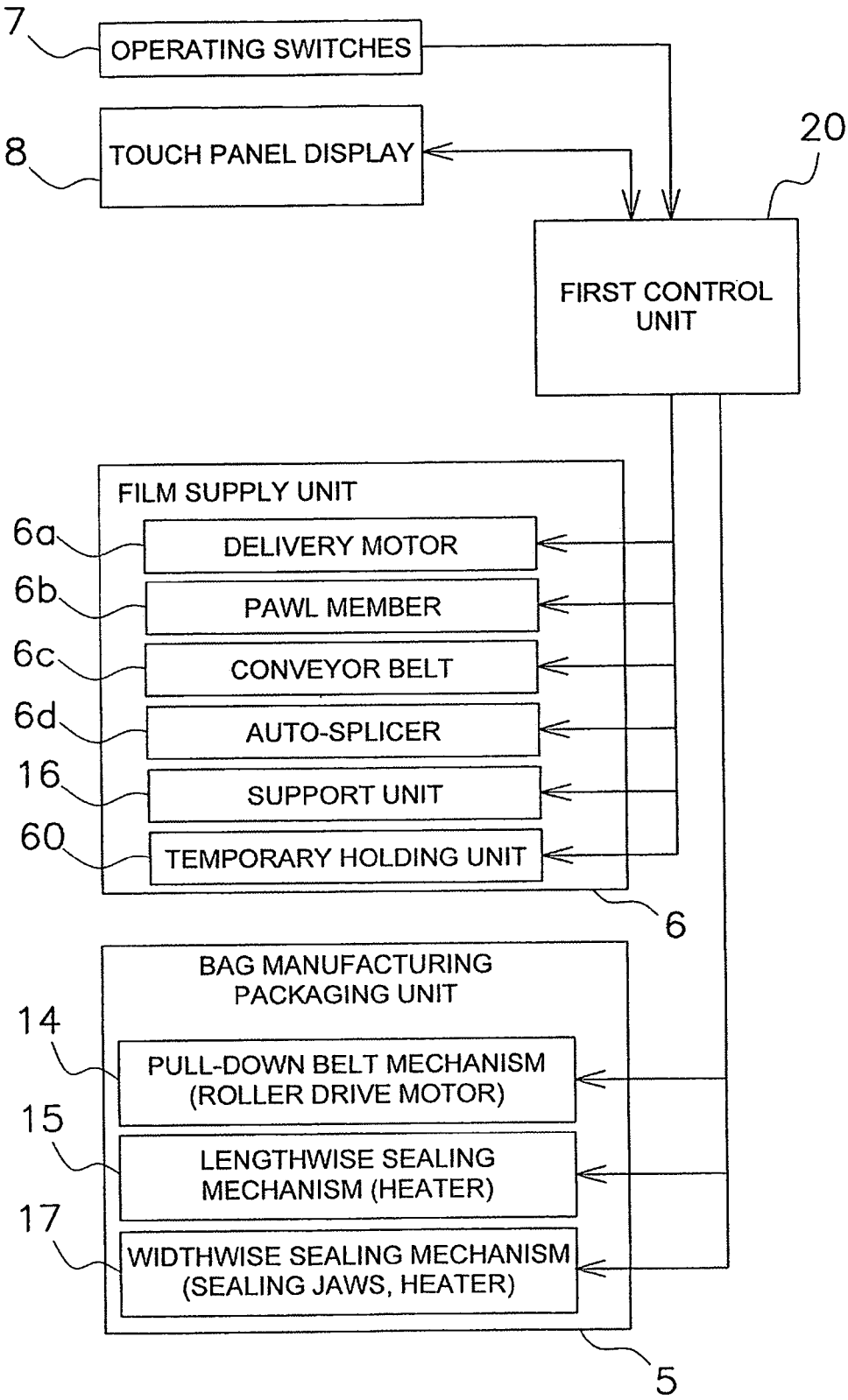
FIG. 2 is a control block diagram of the bag manufacturing packaging apparatus in FIG. 1.

The bag manufacturing packaging apparatus 3 according to the embodiment is a machine in which potato chips or other such foodstuffs to be packaged are wrapped with a film, and the film is formed into a cylinder and is sealed lengthwise and widthwise to manufacture a bag, as shown in FIG. 1. Also, the bag manufacturing packaging apparatus 3 is one of a plurality of bag manufacturing packaging apparatuses provided in a bag manufacturing packaging system 50 (see FIG. 8), which will be described later.

The material to be packaged is dropped basically in a predetermined quantity from a weighing machine 2 which is provided above the bag manufacturing packaging apparatus 3. The weighing machine 2 is a combination weighing apparatus that includes a feeder, a pool hopper 24, a scale hopper 25, and a collecting and expelling chute 26.

Each bag manufacturing packaging apparatus 3 includes a bag manufacturing packaging unit 5 (see FIG. 3), which is a main portion that bags the items to be packaged, a film supply unit 6 that supplies a film F for the bags to the bag manufacturing packaging unit 5, and a first control unit 20 (see FIG. 2) for controlling the movement of the driven portions of the bag manufacturing packaging unit 5 and the film supply unit 6.

<Film Supply Unit 6>

The film supply unit 6 is a unit for supplying the film F in sheet form to a forming mechanism 13 (see FIG. 3) of the bag manufacturing packaging unit 5, and is provided adjacent to the bag manufacturing packaging unit 5. When a film roll 9 of the film supply unit 6 is selected by a second control unit 30 of the bag manufacturing packaging system 50 (see FIG. 9), the film roll 9 is conveyed by a conveying apparatus 51 from a stocking unit (stocking location) 52 (see FIG. 8) to a location beside the bag manufacturing packaging apparatus 3, where the film roll is loaded. The loading (replacement) operation in which a film roll 9 selected by the second control unit 30 is loaded will be described later in detail.

The film F unrolled from the film roll 9 is pulled and conveyed toward the bag manufacturing packaging unit 5 by the operation of a delivery motor 6*a* (see FIG. 2) rotating the film roll 9, a conveyor belt 6*c* and a pull-down belt mechanism 14 of the bag manufacturing packaging unit 5, which are described later.

Also, the film supply unit 6 has one support unit 16 for each bag manufacturing packaging apparatus 3. Each the support unit 16 has, as shown in FIG. 10C, a first shaft (first support shaft) 16*a* for supporting the film roll 9 to be loaded automatically, a bracket 16*b* (moving mechanism, core-removing mechanism, plate) that is mounted on one end of the first shaft 16*a* and is capable of moving relative to the first shaft 16*a* along the first shaft 16*a*, and an air cylinder 16*c* for moving the bracket 16*b*. The bracket 16*b* and the air cylinder 16*c* are an example of the removing mechanism.

The first shaft 16*a* has an open end at one end that is inserted into a core 9*a*, around which the film roll 9 is wound, from the side of this open end so as to support the film roll 9 in cantilevered manner. An air chuck that expands radially outward with air pressure and holds the portion of the core 9*a* is provided to hold the film roll 9 on the first shaft 16*a*.

The bracket 16*b* is disposed at the end of the first shaft 16*a* on the opposite side of the open end, and functions as a stopper for determining the position of the film roll 9 loaded on the first shaft 16*a*. The bracket 16*b* is moved relative to the first shaft 16*a* along the first shaft 16*a* by the air cylinder (drive unit) 16*c* to the open-end side, whereby the core 9*a* of the film roll 9 can be removed and a new film roll can be loaded in a manner to be described later.

The air cylinder 16*c* is a drive mechanism that moves the bracket 16*b* along the first shaft 16*a* relative thereto, and is disposed on the side of the bracket 16*b* opposite the side of the first shaft 16*a*.

Figure 8:
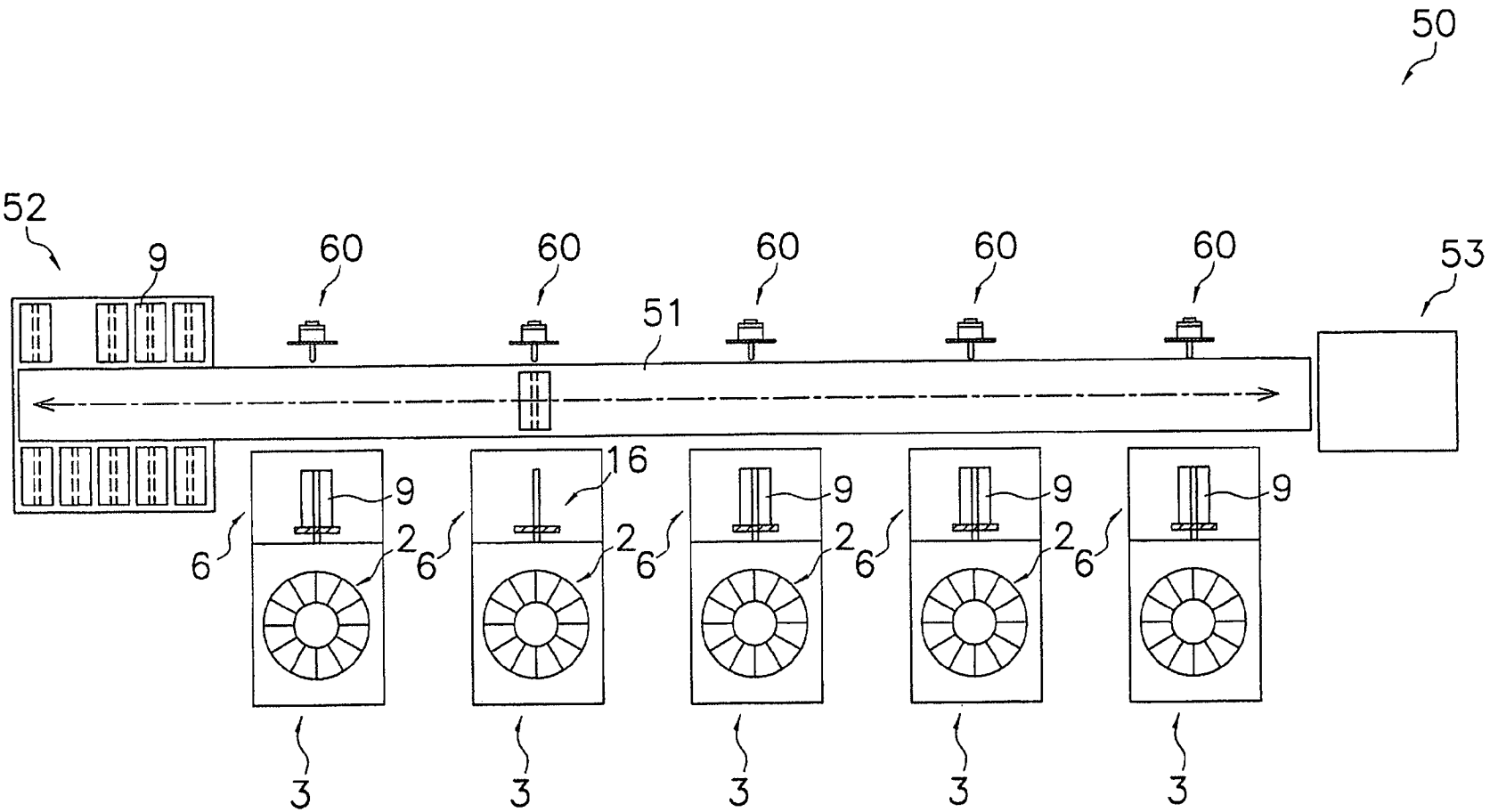
FIG. 8 is a schematic plan view showing the configuration of a bag manufacturing packaging system including a plurality of the bag manufacturing packaging apparatuses shown in FIG. 1.
Figure 10A:
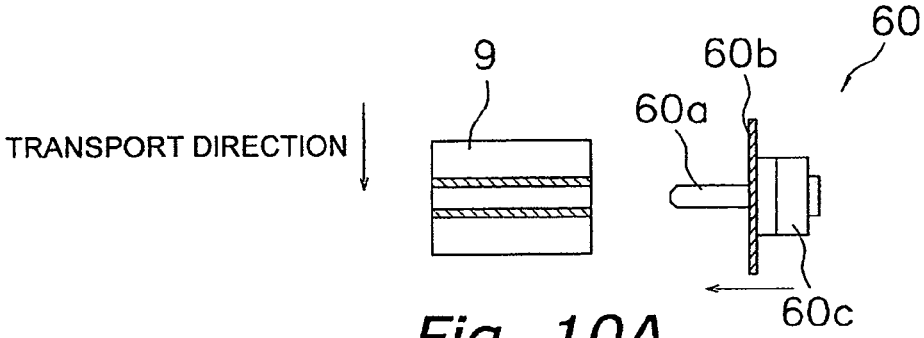
FIGS. 10A through 10D are explanatory diagrams showing the steps of loading the film roll onto the support unit in the bag manufacturing packaging apparatus in FIG. 1.

Furthermore, the film supply unit 6 includes a temporary holding unit 60 that receives the loaded film roll 9 from the conveying apparatus 51 and conveys it to the support unit 16 during control of the automatic loading of the film roll 9 as described later, as shown in FIGS. 8 and 10A.

The temporary holding unit 60 has a second shaft (second support shaft) 60*a* that has an open end at one end that supports the film roll 9 conveyed to the support unit 16, a bracket 60*b* that is mounted on one end of the second shaft 60*a* and is capable of moving along the second shaft 60*a* relative to the second shaft 60*a*, and an air cylinder 60*c* for moving the bracket 60*b*. The bracket 60*b* and the air cylinder 60*c* are an example of the movement mechanism.

The second shaft 60*a* has an open end that is open at one end, which supports the film roll 9 at one end by being inserted through the core 9*a* of the film roll 9 from the open-end side, similar to the first shaft 16*a*. The core 9*a* portion of the film roll 9 is also held by an air chuck on the second shaft 60*a*, similar to the first shaft 16*a*.

The bracket 60*b* is disposed at the end of the second shaft 60*a* on the opposite side of the open end, and functions as a stopper for determining the position of the film roll 9 loaded on the second shaft 60*a*, similar to the bracket 16*b*. The bracket 60*b* is moved relative to the second shaft 60*a* by an air cylinder (drive unit) 60*c* to the open-end side, similar to the bracket 16*b*, thereby passing the supported film roll 9 to the support unit 16, or discarding the core 9*a* to a disposal location 53.

The air cylinder 60*c* is a drive mechanism that moves the bracket 60*b* along the second shaft 60*a* relative thereto, and is disposed on the side of the bracket 60*b* opposite the side of the second shaft 60*a*.

Control of the loading, the replacement, and the core removal of the film roll 9 using the support unit 16 and the temporary holding unit 60 will be described in detail later.

The film supply unit 6 includes a pawl portion 6*b* (see FIG. 5) automatically pick up an end (the distal end) F1 of the film F (the outermost end of the film F of the film roll 9, see FIG. 6) from the automatically loaded film roll 9, and a conveyor belt 6*c* which conveys the end F1 of the film F picked up from the film roll 9 by the pawl portion 6*b* to an auto-splicer (film joining apparatus, splicer unit) 6*d* (see FIG. 2) disposed on the downstream side, as shown in FIGS. 4A through 4E and FIG. 5.

The pawl portion 6*b* is mounted on the end of the conveyor belt 6*c*, which is pivotably supported by a frame (not shown in Figures) of the film supply unit 6. The pawl portion 6*b* is configured to pick up the end F1 of the film F from the film roll 9 with the pointed distal end portion, as shown in FIG. 5.

Figure 5:
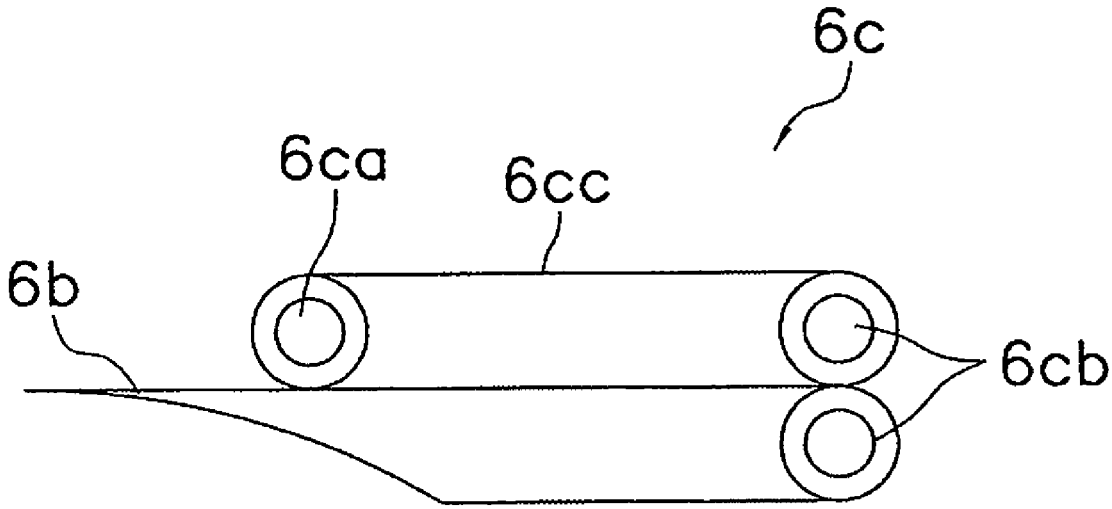
FIG. 5 is a side view showing the schematic configuration of a pawl member and a conveyor belt used to pick up the end of the film out from the film roll shown in FIGS. 4A through 4E.

The conveyor belt 6*c* is formed integrally with the pawl portion 6*b*, and has a drive roller 6*ca*, driven rollers 6*cb*, and a looped belt 6*cc*, as shown in FIG. 5. The conveyor belt 6*c* sandwiches the end F1 of the film picked up from the film roll 9 by the pawl portion 6*b* and conveys the film roll 9 to the auto-splicer 6*d* on the downstream side.

The auto-splicer 6*d* attaches to itself by suction the root end (beginning end) F0 of a film F when all of the film F has is unrolled from the film roll 9. The film F pulled out from a newly loaded film roll 9 is also attached to the auto-splicer 6*d* by suction in the same manner. In this manner, the root end F0 of the film F of the old film roll 9 and the end F1 of the film F of the newly loaded film roll 9 are automatically joined together. Thus, by joining the end (beginning end F0) of the old film roll 9 with the end F1 of the newly loaded film roll 9, it is possible to continuously supply a film F to the bag manufacturing packaging apparatus 3 even when the film roll 9 is replaced.

The process of picking up the end F1 of the film F from the film roll 9 as performed by the first control unit 20 is described below with reference to FIGS. 4A through 4E.

Figure 4A:
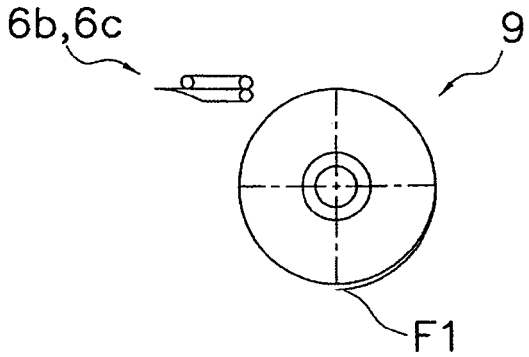
FIGS. 4A through 4E are schematic diagrams showing the steps of picking up the end of the film out from the loaded film roll.

In the bag manufacturing packaging apparatus 3 of the present embodiment, the pawl portion 6*b* is disposed near the loaded film roll 9, as shown in FIG. 4A.

Figure 4B:
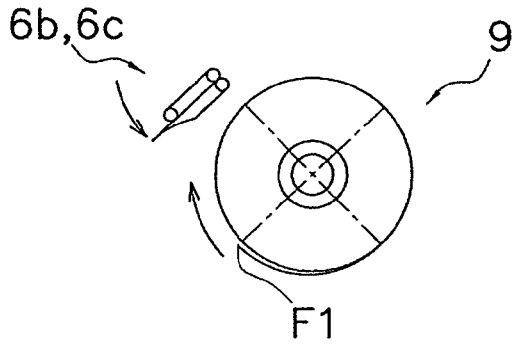
Figure 4C:
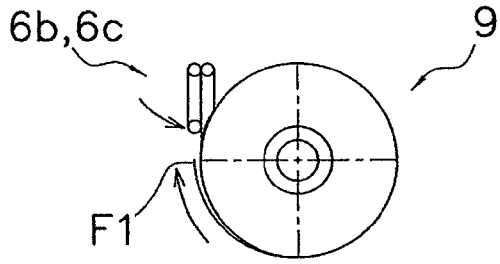

The first control unit 20 pivots the pawl portion 6*b* and the conveyor belt 6*c* around the area near the end of the conveyor belt 6*c* opposite the pawl portion 6*b*, as shown in FIG. 4B. The distal end of the pawl portion 6*b* is thereby moved to a position that is 0.3 to 1.0 mm apart from the film surface of the film roll 9, as shown in FIG. 4C. Thus, since the pawl portion 6*b* is positioned nearby near the film roll 9 after the film roll 9 is loaded, the pawl portion 6*b* does not interfere with the film F during the loading of the film roll 9. Therefore, it is possible to reduce damages to the film F and other such problems.

Figure 4D:
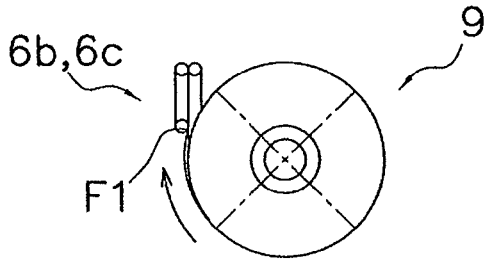
Figure 4E:
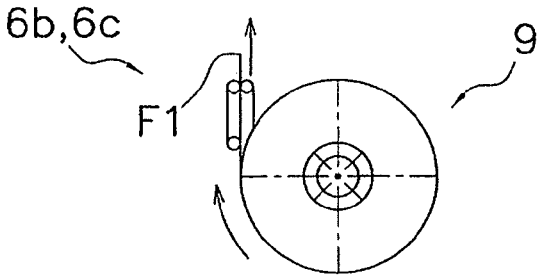

Next, the first control unit 20 rotates the film roll 9 one rotation with the delivery motor 6*a* in the state shown in FIG. 4C. The end F1 of the film F (see FIG. 6B), which is slightly raised up from the film surface of the film roll 9 due to an adhesive member 9*b* described later, engages and is lifted up by the distal end portion of the pawl portion 6*b*, as shown in FIG. 4D. At this time, the first control unit 20 drives the conveyor belt 6*c*, and the end F1 of the film F is therefore automatically conveyed directly towards the downstream side, as shown in FIG. 4E. After the first control unit 20 has picked up the end F1 of the film F from the film roll 9, the pawl portion 6*b* disengages from the film F. Then, the first control unit 20 pivots the pawl portion 6*b* once again and returns it to its original standby position.

The end F1 of the film F conveyed downstream by the conveyor belt 6*c* is conveyed to the auto-splicer 6*d* (see FIG. 2) disposed downstream, where the end F1 is joined with the end of the film F of the old film roll 9.

<Bag Manufacturing Packaging Unit 5>

Figure 3:
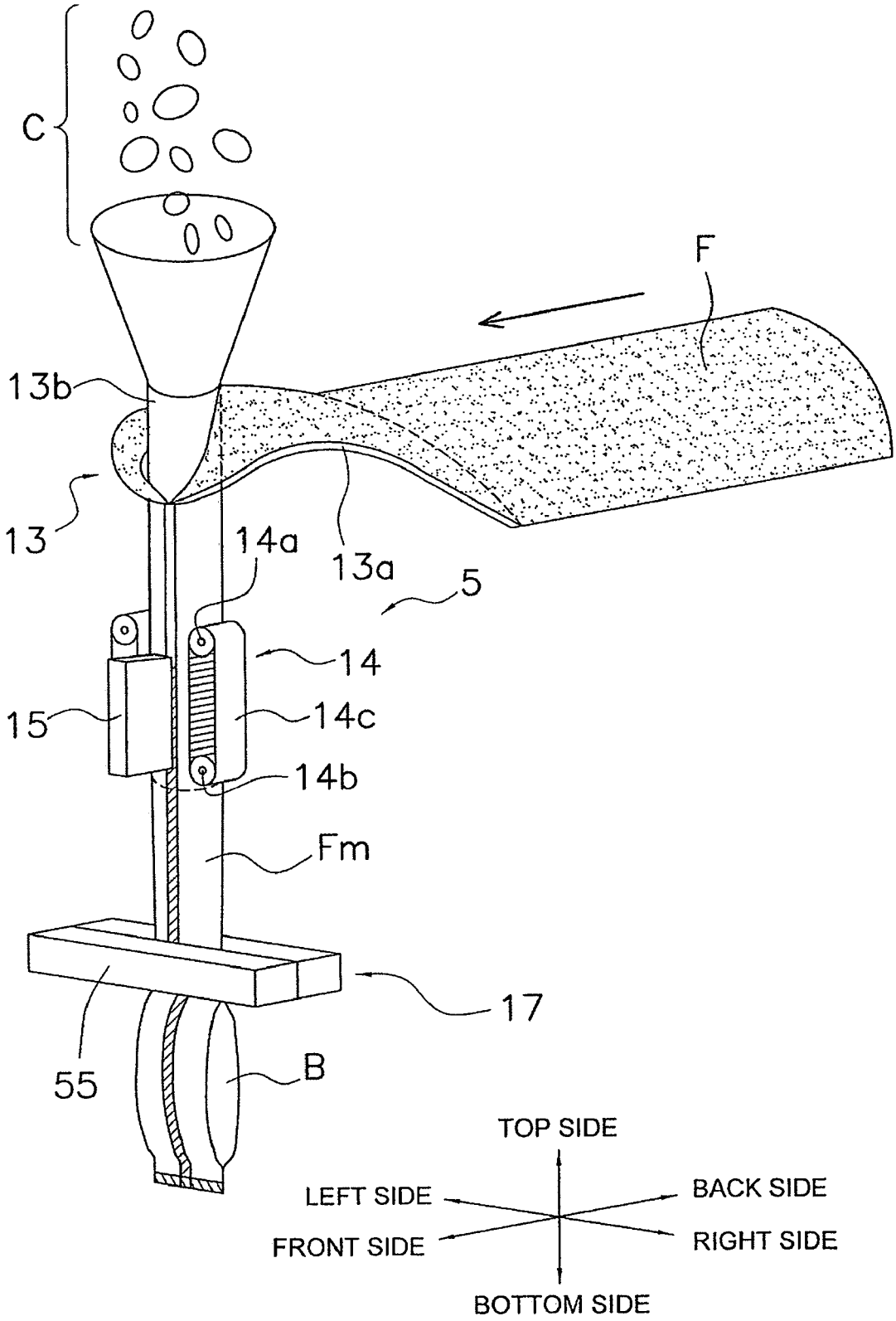
FIG. 3 is a perspective structural diagram schematically showing a bag manufacturing packaging unit of the bag manufacturing packaging apparatus in FIG. 1.

The bag manufacturing packaging unit 5 has a forming mechanism 13 that forms the film F delivered in a sheet form into a cylindrical shape, a pull-down belt mechanism 14 that conveys the cylindrically-shaped film F (hereinafter referred to as cylindrical film Fm) downward, a lengthwise sealing mechanism 15 that seals the overlapping portions of the cylindrical film Fm lengthwise, and a widthwise sealing mechanism 17 that seals the top and bottom ends of the bag B by sealing the cylindrical film Fm widthwise, as shown in FIG. 3.

<Forming Mechanism 13>

The forming mechanism 13 has a tube 13*b* and a former 13*a*. The tube 13*b* is a cylindrically shaped member and is open at the top and bottom ends. Material to be packaged C that has been weighed by the weighing machine 2 is dropped into the opening at the top end of the tube 13*b*. The former 13*a* is disposed so as to enclose the tube 13*b*. The shape of the former 13*a* is designed so that the film F that is unreeled from the film roll 9 in sheet form is formed into a cylindrical shape as it passes between the former 13*a* and the tube 13*b* (see FIG. 3). Also, the tube 13*b* and the former 13*a* of the forming mechanism 13 can be replaced with ones with different sizes, according to the size of the bags to be manufactured.

<Pull-Down Belt Mechanism 14>

The pull-down belt mechanism 14 is a mechanism that holds the cylindrical film Fm wound around the tube 13*b* and conveys the cylindrical film Fm downward, and has belts 14*c* that sandwich the tube 13*b* from both the left and right sides, as shown in FIG. 3. In this pull-down belt mechanism 14, the belts 14*c* having a holding function are rotated by a driving roller 14*a* and a driven roller 14*b* to move the cylindrical film Fm downward. In FIG. 3, an illustration of a roller drive motor, which is for rotating the driving roller 14*a* and the other members, is omitted.

<Lengthwise Sealing Mechanism 15>

The lengthwise sealing mechanism 15 is a mechanism for heating and sealing vertically the overlapping portions of the cylindrical film Fm that is wound around the tube 13*b*, while pressing the overlapping portions against the tube 13*b* with a specific amount of pressure. This lengthwise sealing mechanism 15 is positioned on the front surface of the tube 13*b*, and has a heater and a heater belt that is heated by the heater and comes in contact with the overlapping portions of the cylindrical film Fm. Though not shown in the Figure, the lengthwise sealing mechanism 15 also has a drive apparatus for drawing the heater belt to and away from the tube 13*b*.

<Widthwise Sealing Mechanism 17>

The widthwise sealing mechanism 17 is disposed underneath the forming mechanism 13, the pull-down belt mechanism 14, and the lengthwise sealing mechanism 15. The widthwise sealing mechanism 17 is a mechanism that includes a pair of sealing jaws 55 that accommodate the heater, as shown in FIG. 3.

The pair of sealing jaws 55 are designed to press against each other with the film Fm therebetween to hold the cylindrical film Fm in place and to seal, by the application of pressure and heat, the portions of the cylindrical film Fm that constitute the top and bottom ends of the bags.

<First Control Unit 20>

The first control unit 20 performs various types of control for the weighing machine 2 and the bag manufacturing packaging apparatus 3. The first control unit 20 has a CPU, ROM, RAM, and the like, and is disposed in the interior of the bag manufacturing packaging apparatus 3. Since the components that constitute the first control unit 20 are well known, detailed explanation and illustration thereof will be omitted. The first control unit 20 also performs various types of control according to operations and settings inputted from the operating switches 7 and touch panel display 8 shown in FIGS. 1 and 2.

Specifically, the first control unit 20 controls the delivery motor 6*a* for rotating the film roll 9 and delivering the film F in the film supply unit 6, the pawl portion 6*b* for picking up the end F1 of the film F from the film roll 9, the conveyor belt 6*c* for conveying the end F1 picked up by the pawl portion 6*b* downstream, the auto-splicer 6*d* for joining the end F1 of the film F conveyed by the conveyor belt 6*c* together with the cut end of the old film roll 9, the support unit 16 for supporting the film roll 9, the temporary holding unit 60 for conveying the film roll 9 from the conveying apparatus 51 to the support unit 16, and driven portions of the various mechanisms of the bag manufacturing packaging unit 5.

Furthermore, the first control unit 20 controls the driving of the feeder (not shown) of the weighing machine 2, the pool hopper 24, the scale hopper 25, and the like. In the bag manufacturing packaging apparatus 3, the first control unit 20 furthermore acquires necessary information from the sensors in the weighing machine 2 and the bag manufacturing packaging apparatus 3, and uses this information in the various types of control.

In addition to controlling the continuous movement for continuous weighing, bag manufacturing, and packaging, the first control unit 20 can also control intermittent movement for intermittent weighing, bag manufacturing, and packaging. In the intermittent movement control, the film F is intermittently supplied from the film supply unit 6 to the bag manufacturing packaging unit 5 in the bag manufacturing packaging apparatus 3, and the bags are intermittently manufactured in the bag manufacturing packaging unit 5.

In particular, the first control unit 20 controls the driving of the air cylinders (drive units) 16*c* and 60*c* for moving the brackets 16*b* and 60*b* in the support unit 16 and the temporary holding unit 60 during the automatic loading, automatic replacement, and core removal of the film roll 9, to be described later.

<Film Roll 9>

Figure 6A:
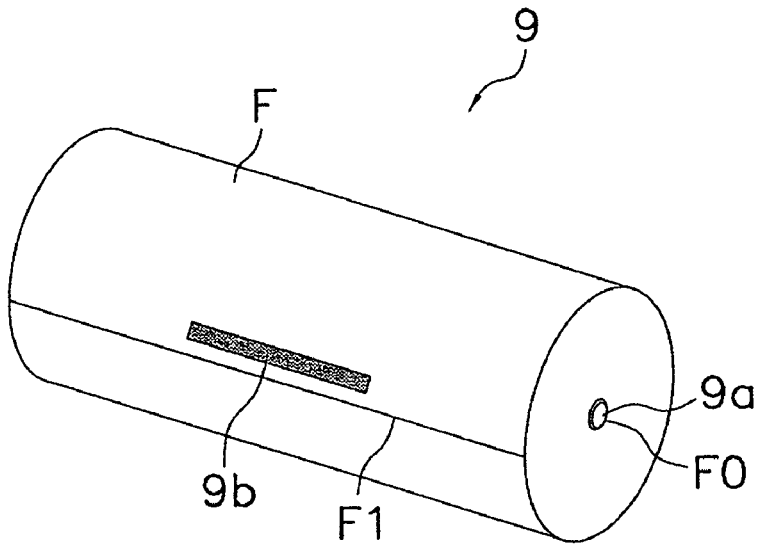
FIG. 6A is a perspective view showing the film roll loaded in the bag manufacturing packaging apparatus in FIG. 1.
Figure 6B:
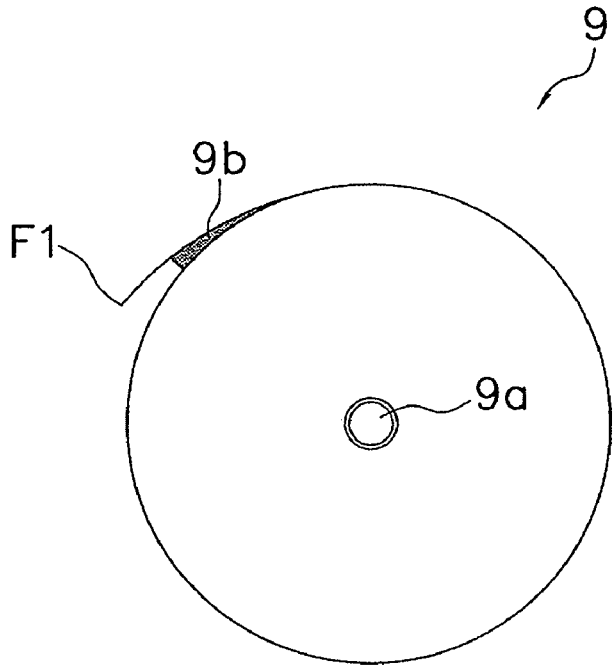
FIG. 6B is a side view thereof.

In the present embodiment, a film roll 9 such as the one shown in FIGS. 6A and 6B is used as the film roll installed in the bag manufacturing packaging apparatus 3.

Specifically, the film roll 9 of the present embodiment is configured from a rectangular film F wound around the core 9*a*, and an adhesive member 9*b* for temporarily holding the film surface and the end F1 of the film F in place. By temporarily fixing the end F1 of the film F in relation to the film roll 9, it is possible to reduce the occurrence of instances in which the end F1 of the film F is separated from the film roll 9 and the resulting problems that occur during transport of the film roll 9.

The adhesive member 9*b* for temporarily fixing the end F1 of the film F in place is disposed within the 10-20 mm range from the edge of the end F1 of the Film F toward the upstream direction of the conveyance direction of the film F or toward the root end F0 of the film F, on a reverse side that comes into contact with the film F underneath, as shown in FIGS. 6A and 6B. The adhesive member 9*b* is formed so as to increase in thickness in the downstream direction toward the end F1, as shown in FIG. 6B. Therefore, in the film roll 9 of the present embodiment, the end F1 of the film F can be raised up from the underneath film surface of the film roll 9 by about 0.5 to 1.0 mm. The adhesive member 9*b* is not uniform in thickness, but increases in thickness in the direction toward the end F1. Therefore, it is possible to prevent the portion of the film F inward of the adhesive member 9*b* from becoming raised up from the underneath surface of the film roll 9, and thereby avoid instances of the film F being damaged and other such problems. Thus, only the end F1 is raised up from the film roll 9 from the film surface by the amount minimally necessary. Therefore, it is possible to obtain a film roll 9 in which the end F1 is easily picked up without damaging the underneath film F of the film roll 9.

In this embodiment, a double-sided tape is used as the adhesive member 9*b*. This adhesive member 9*b* preferably has less adhesive strength than a regular adhesive tape, and has so-called low-sticky adhesive strength. As a result of using such a low-sticky adhesive member 9*b*, the end F1 of the film F can remain adhered to the film surface while the film roll 9 is being conveyed, and can easily be pulled off from the film roll 9 once the film roll 9 is loaded on the support unit 16.

Figure 7A:
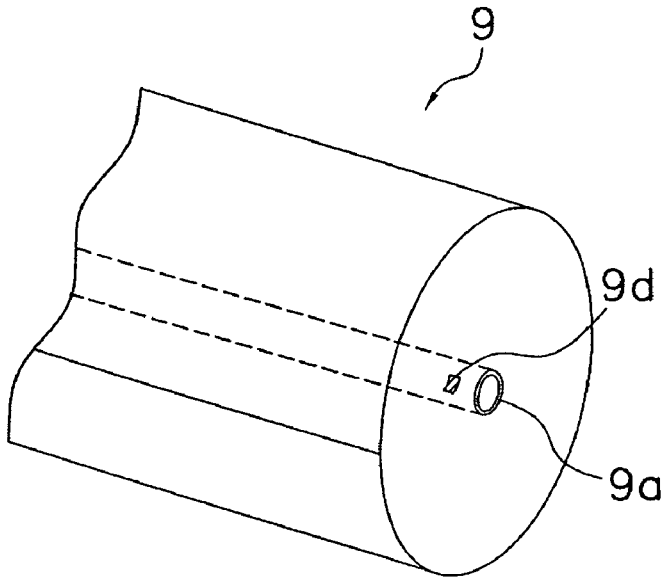
FIG. 7A is a perspective view showing the ID tag attached to the film roll.
Figure 7B:
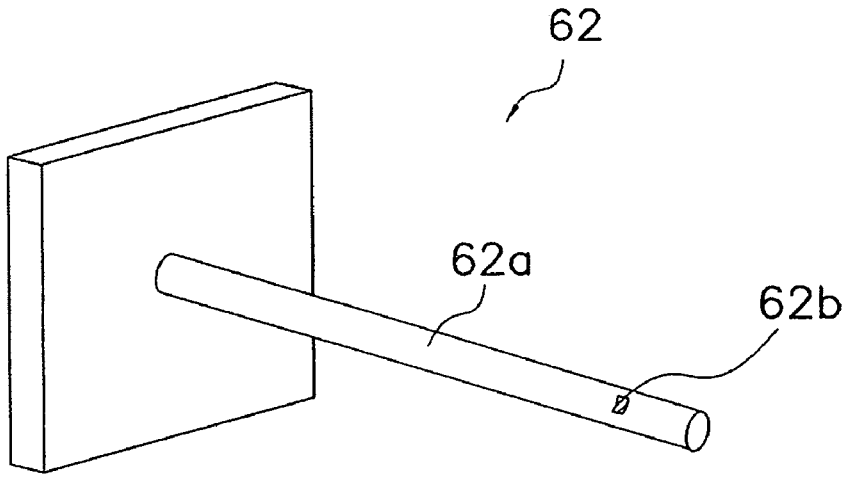
FIG. 7B is a diagram showing the relationship between the ID tag attached to the film roll and the reading device.

An ID tag (memory unit) 9*d* is attached to each film roll 9, as shown in FIG. 7A. The ID tag 9*d* stores data pertaining to products for each film roll 9, the width of the film F, data on the materials and the like, the date the film was stored into the stocking unit 52, the amount of film F remaining; and other such data. The ID tag 9*d* corresponds to the memory unit 31 included in the control block diagram in FIG. 9. The data stored in the ID tag 9*d* are read by a reading unit 62*b* mounted in a third shaft 62*a* of a stock support unit 62 that supports the film roll 9 in the stocking unit 52, as shown in FIG. 7B.

<Configuration of the Bag Manufacturing Packaging System 50>

The bag manufacturing packaging system 50 of the present embodiment includes a plurality of the bag manufacturing packaging apparatuses 3 described above as shown in FIGS. 8 and 9, and is a system that automatically selects, loads, and replaces the film roll 9, and removes the core of the film roll in each bag manufacturing packaging apparatus 3.

The bag manufacturing packaging system 50 of this embodiment includes five bag manufacturing packaging apparatuses 3 described above as shown in FIG. 8. The bag manufacturing packaging system 50 also includes a conveying apparatus 51 for conveying the newly loaded (or taken off from the support unit 16) film roll 9, a stocking unit 52 for storing a plurality of film rolls 9, and a disposal location 53 for cores 9*a* and unnecessary films F and the like.

The conveying apparatus 51 is a belt conveyor in which a looped conveyor belt is rotated and products are conveyed on the conveyer belt. The apparatus conveys the film rolls 9 selected by the second control unit 30 to a location beside the loaded bag manufacturing packaging apparatuses 3.

The stocking unit 52 includes a plurality (ten in the present embodiment) of the stock support units 62 shown in FIG. 7B, and is an automatic depository for storing a plurality of film rolls 9 not currently being used in the bag manufacturing packaging apparatuses 3. The stocking unit 52 as shown in the plan view of FIG. 8 has ten slots for the film rolls 9. In practice, however, the stock unit generally has a plurality of layers, each layer having ten slots, such that the stock unit can accommodate several dozen film rolls 9 in total.

The stock support unit 62 has a third shaft 62*a* and a reading unit 62*b*. The stock support unit 62 is configured so that when the film roll 9 to be newly loaded onto a bag manufacturing packaging apparatus 3 is selected by the second control unit 30, the stock support unit 62 moves to the conveying apparatus 51 while supporting this film roll 9, and transfers the film roll 9 to the conveying apparatus 51. The film roll 9 can be transferred from the stock support unit 62 of the stocking unit 52 to the conveying apparatus 51 by moving the brackets 16*b* and 60*b* of the support unit 16 and the temporary holding unit 60 described above with the air cylinders 16*c*, and 60*c* or another such drive mechanism.

The third shaft 62*a* is a rod-shaped member inserted through the middle of the core 9*a* of the film roll 9. The third shaft supports the film roll 9 in the stocking unit 52.

The reading unit 62*b* reads the various data for each film roll 9 stored in the ID tags 9*d* (see FIG. 7A) attached to the cores 9*a* of the film rolls 9, and sends the data to the second control unit 30.

<Second Control Unit 30>

The second control unit 30 is configured from a CPU, a ROM, a RAM, and the like. The second control unit 30 is provided inside one of the bag manufacturing packaging apparatuses 3 of the bag manufacturing packaging system 50 together with the first control unit 20 of that bag manufacturing packaging apparatuses 3. The second control unit 30 and the first control unit 20 of that bag manufacturing packaging apparatuses 3 are operatively connected. The second control unit 30 is also connected to the plurality of bag manufacturing packaging apparatuses 3, the conveying apparatuses 51, and the stocking units 52, which constitute the bag manufacturing packaging system 50. The second control unit 30 performs the automatic loading control of the film rolls 9 in each bag manufacturing packaging apparatus 3 in the bag manufacturing packaging system 50, the automatic removal control of the cores 9*a*, and other such various controls in the entire bag manufacturing packaging system 50.

The second control unit 30 receives individual information of each film roll 9 (such as corresponding product, film width, material, storage date, remaining amount of film) from the reading unit 62*b* that reads the individual information stored in the ID tags 9*d* attached to each of the plurality of film rolls 9 stored in the stocking unit 52. The second control unit 30 thereby selects the film roll 9 for the bag manufacturing packaging apparatus 3 to be loaded and takes out the film roll 9 from the stocking unit 52 based on the individual information of the film roll 9 received from the reading unit 62*b* when controlling the automatic loading of the film rolls 9.

Furthermore, the second control unit 30 conveys the selected film roll 9 to a location beside the bag manufacturing packaging apparatus 3 with the conveying apparatus 51, and automatically loads the film roll 9 in the bag manufacturing packaging apparatus 3 via the first control unit 20.

<Automatic Loading (Replacement) Control of Film Rolls in Bag Manufacturing Packaging System 50>

Figure 9:
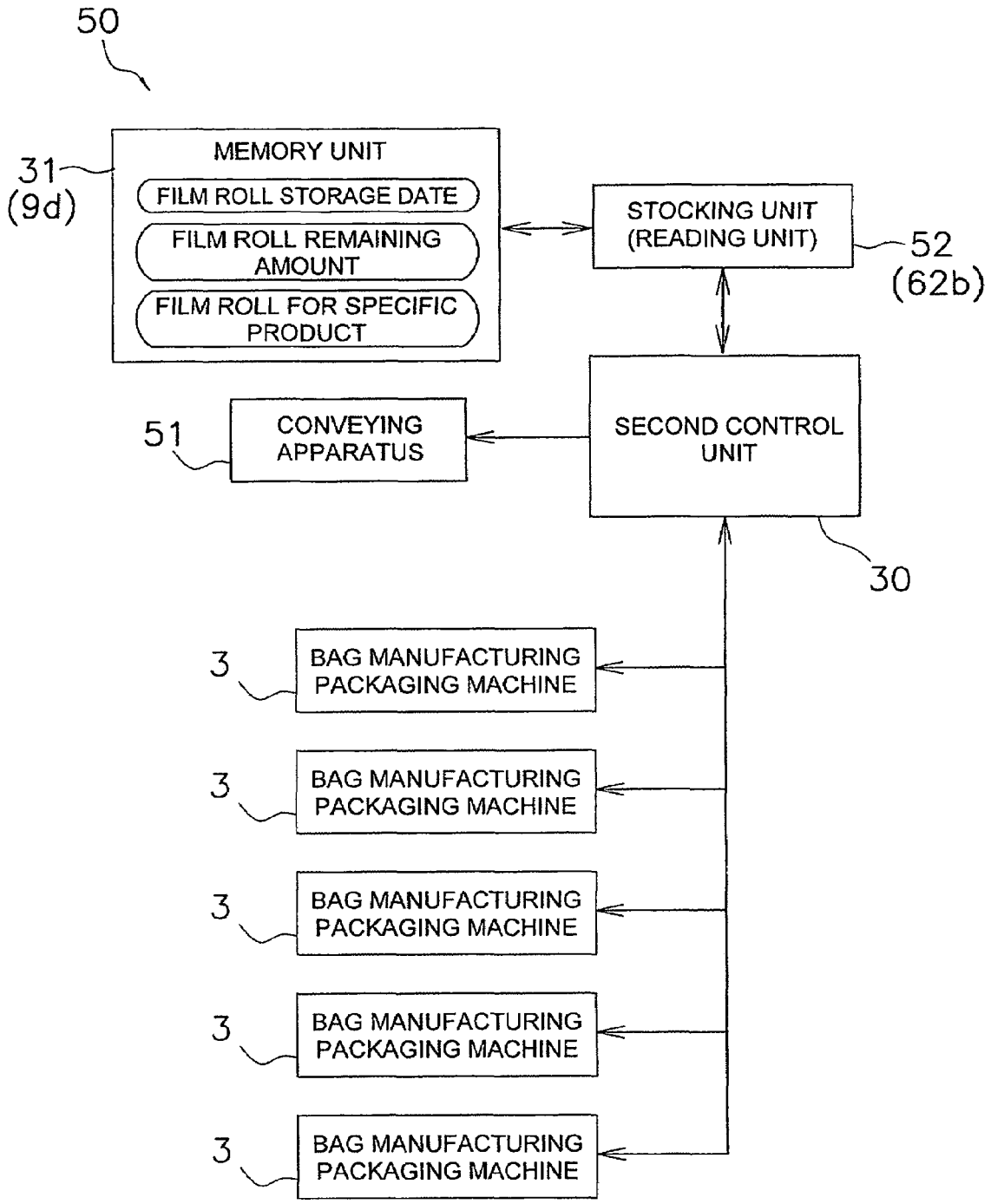
FIG. 9 is a control block diagram constituting the bag manufacturing packaging system shown in FIG. 8.

In the bag manufacturing packaging system 50 of the present embodiment, when a film roll 9 is to be automatically loaded in the bag manufacturing packaging apparatuses 3, an adequate film roll 9 is selected from among the plurality of film rolls 9 stored in the stocking unit 52 shown in FIG. 8 based on the various data stored in the memory unit 31 (ID tag 9*d* (see FIG. 7A) shown in FIG. 9.

Examples of the various data stored in the memory unit 31 (ID tag 9*d*) include film roll data such material, width, and other parameters of the film F of the film roll 9 that are correlated with the types of product to be packaged in the bag manufacturing packaging apparatus 3; data pertaining to the date the film roll 9 was stored; and data pertaining to the remaining amount of film in the film roll 9.

Specifically, when a new film roll 9 is to be loaded onto the bag manufacturing packaging apparatus 3, the second control unit 30 first selects, based on the film roll data, a film roll 9 corresponding to the product to be packaged in the bag manufacturing packaging apparatus 3 from among the plurality of film rolls 9 stored in the stocking unit 52. Next, if there is a plurality of the same types of corresponding film rolls, the film roll 9 with the oldest storage data is selected from among these same types of film rolls 9 using the data of the storage dates of the film rolls stored in the memory unit 31. Thereby, when there is a plurality of the same types of film rolls in the stocking unit 52, the film rolls with the oldest storage dates can be given a priority.

Furthermore, when a plurality of the same types of film rolls 9 with the same storage date are stored, the second control unit 30 similarly selects the film roll 9 with the least amount of remaining film, using the data pertaining to the remaining amount of film F in the film roll 9 stored in the memory unit 31. Thereby, when similar film rolls 9 have the same storage date, a film roll 9 with the least amount of remaining film F is given a priority and selected. As a result, it is possible to prevent a large number of left-over film rolls 9 with a small amount of film F remaining in the inventory, thereby preventing an unnecessary increase in the inventory of the film rolls 9 in the stocking unit 52.

Where the operator inputs the amount of film F to be used in one day based on the production plans, the second control unit 30 compares the amount of film F to be used for that day with the remaining amount of film stored in the memory unit 31. If the planned amount of film F to be used for that day exceeds the amount of film remaining in the loaded film roll 9, a similar film roll 9 is taken out from the stocking unit 52, conveyed with the conveying apparatus 51 and held in standby at a location beside the operating bag manufacturing packaging apparatus 3.

As described above, when it is known in advance that all of the film F will be depleted from a film roll 9 during that day's operation, the system links with the real time production conditions and conveys and holds in standby a similar film roll 9 at a location beside the bag manufacturing packaging apparatus 3 that uses the film roll 9 being used up. In this manner, it is possible to efficiently load a film roll 9 when the film F is depleted. Furthermore, the automatic selection of the film roll 9 makes it possible to reduce mistakes in the replacement timing or selection of the film rolls 9 as compared with the case where the film rolls 9 are manually selected by the operator.

The steps of automatically loading the film rolls 9 thus selected by the second control unit 30 onto the bag manufacturing packaging apparatuses 3 is described below with reference to FIGS. 10A through 10C.

First, the film roll 9 selected by the second control unit 30 is taken out from the stocking unit 52 and is conveyed by the conveying apparatus 51 to the side of the bag manufacturing packaging apparatus 3 where this film roll 9 is to be loaded (see the location beside the second bag manufacturing packaging apparatus 3 from the left in FIG. 8).

The temporary holding unit 60 disposed on the bag manufacturing packaging apparatus 3 is moved toward the film roll 9 on the conveying apparatus 51, as shown in FIG. 10A.

Figure 10B:
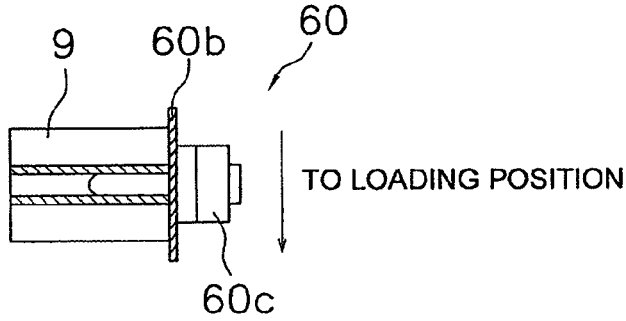
Figure 10C:
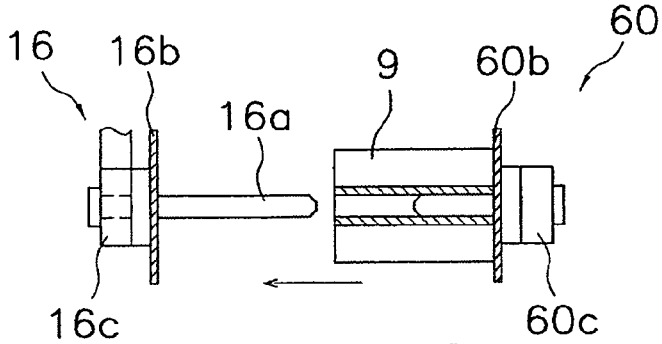
Figure 10D:
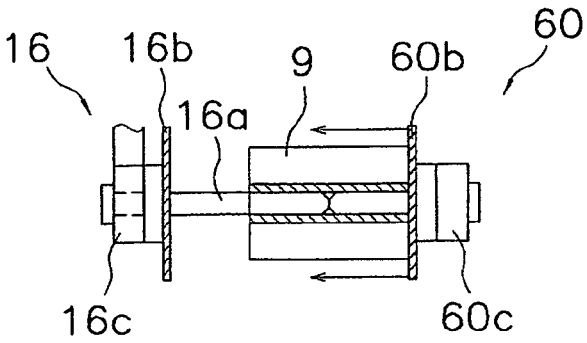

The temporary holding unit 60 inserts the second shaft 60*a* from the open-end side into the core 9*a* of the film roll 9 and supports the film roll 9, as shown in FIG. 10B.

The film roll 9 supported by the second shaft 60*a* is conveyed in its supported state shown in FIG. 10B to the loading position on the bag manufacturing packaging apparatus 3. At the loading position on the bag manufacturing packaging apparatus 3, the centers of the first shaft 16*a* and the second shaft 60*a* are aligned by a positioning sensor (not shown). The open end of the first shaft 16*a* of the support unit 16 and the open end of the second shaft 60*a* of the temporary holding unit 60 then are opposite one another, and the first shaft 16*a* and second shaft 60*a* are arranged coaxially to lie on a straight line as shown in FIG. 10C.

In this state, the bracket 60*b* of the temporary holding unit 60 is advanced to the open-end side relative to the second shaft 60*a* by the air cylinder (drive unit) 60*c*, as shown in FIG.

Figure 11A:
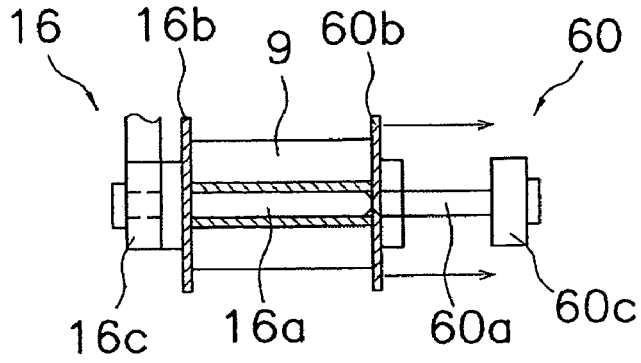
FIGS. 11A through 11C are explanatory diagrams showing the steps following the steps of loading the film roll shown in FIGS. 10A through 10D.

10D. The film roll 9 thereby moves from the temporary holding unit 60 toward the support unit 16 so as to be pushed out by the bracket 60*b*, as shown in FIG. 11A. As a result, the film roll 9 is passed to the support unit 16 from the temporary holding unit 60. The film roll 9 is held by the air chuck of the first shaft 16*a* on the support unit 16 to which the film roll 9 has been passed from the temporary holding unit 60.

Figure 11B:
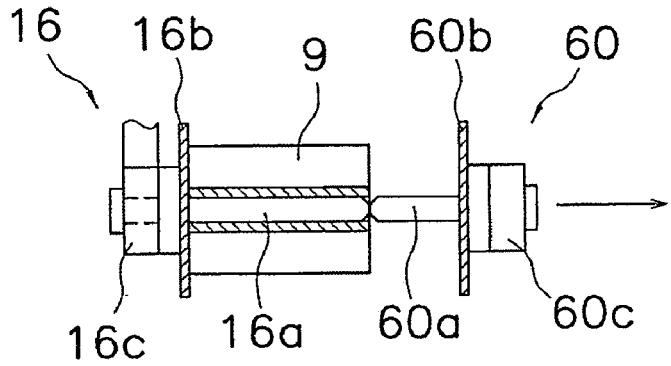
Figure 11C:
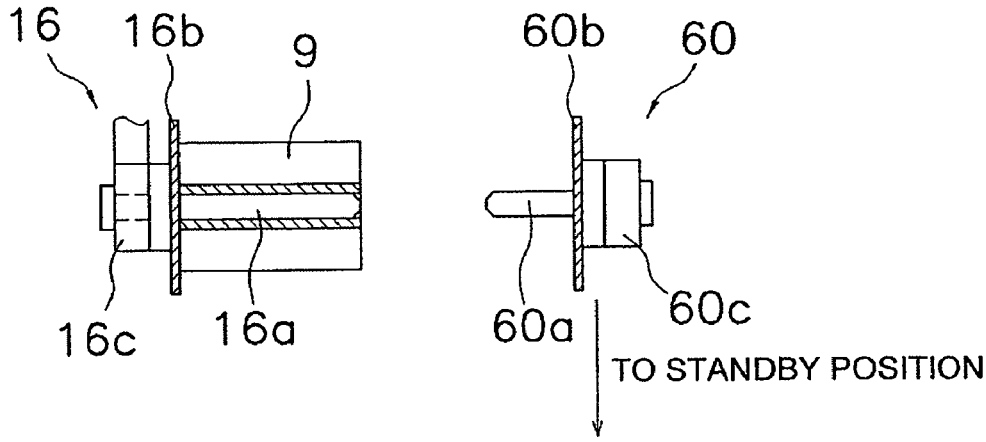

Also, the temporary holding unit 60 from which the film roll 9 has been taken returns the bracket 60*b* to its original position with the air cylinder 60*c* as shown in FIG. 11B, and returns to a standby position next to the conveying apparatus 51 as shown in FIG. 11C.

As a result of the steps described above, in the bag manufacturing packaging system 50 of the present embodiment, it is possible to automatically perform the operations from selecting to loading the film roll 9, which have previously been performed manually. As a result, production efficiency can be improved, production-line labor can be reduced and reduction of load can be achieved by automating the loading operation of the film rolls 9, which previously required heavy labor.

When the film roll 9 currently loaded on the bag manufacturing packaging apparatus 3 is to be replaced with another film roll 9, this process is controlled as follows by the second control unit 30 before the automatic loading of the film roll 9 is performed as described above.

Specifically, first, the temporary holding unit 60 moves to a position where the open ends of the second shaft 60*a* and the first shaft 16*a* that is supporting the current film roll 9 in the support unit 16 of the bag manufacturing packaging apparatus 3 are coaxially aligned on a straight line (see FIG. 11B).

Then, after the air chuck in the first shaft 16*a* of the support unit 16 released, the bracket 16*b* is moved by the air cylinder 16*c*, and the film roll 9 is passed to the temporary holding unit 60. The temporary holding unit 60 that has received the film roll 9 from the support unit 16 moves onto the conveying apparatus 51 and passes the film roll 9 to the conveying apparatus 51. At this time, the film roll 9 is passed to the conveying apparatus 51 by moving the bracket 60*b* with the air cylinder 60*c*.

Next, the film roll 9 is conveyed by the conveying apparatus 51 to the stocking unit 52, to be supported by an empty stock support unit 62 in the stocking unit 52. The information pertaining to the film roll 9 such as its remaining amount of film and the like and stored in the ID tag 9*d* is read by the reading unit 62*b* of the stock support unit 62 that supports the film roll, and is sent to the second control unit 30.

The operation of removing the film roll 9 that has been loaded onto the bag manufacturing packaging apparatus 3, which has previously been done manually, can thereby be automatically performed by the bag manufacturing packaging apparatus 3. As a result, it is possible to automate all the steps of the bag manufacturing packaging system 50, including removal and loading of the film roll 9.

<Core Removal Control by Bag Manufacturing Packaging System 50>

When the film F of the film roll 9 has been used up and only the core 9*a* remains in the film supply unit 6 of the bag manufacturing packaging apparatus 3, the core 9*a* must be removed from the first shaft 16*a* before a new film roll 9 is loaded. In the bag manufacturing packaging system 50 of the present embodiment, the core 9*a* is automatically removed by the second control unit 30 via the first control unit 20.

Figure 12A:
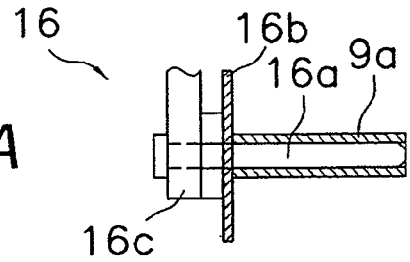
FIGS. 12A through 12F are explanatory diagrams showing the steps of removing the core from the support unit of the bag manufacturing packaging apparatus 3.
Figure 12B:
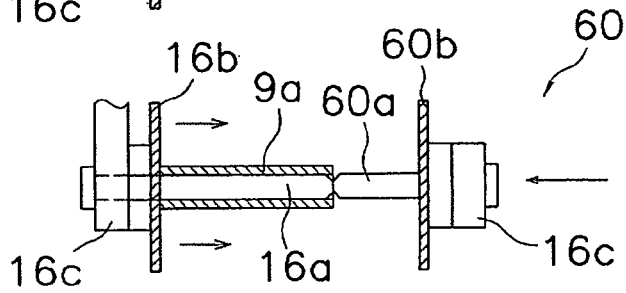

Specifically, when the film F has been used up and only the core 9*a* remains as shown in FIG. 12A, the second control unit 30 moves the temporary holding unit 60 to the front of the support unit 16, as shown in FIG. 12B. At this time, the centers of the first shaft 16*a* and the second shaft 60*a* are aligned with a positioning sensor (not shown) in the same manner as in the case in which the film roll 9 is loaded as described above. The open ends of the first shaft 16*a* and the second shaft 60*a* are opposite one another, and the first shaft 16*a* and the second shaft 60*a* coaxially lie on a straight line.

Figure 12C:
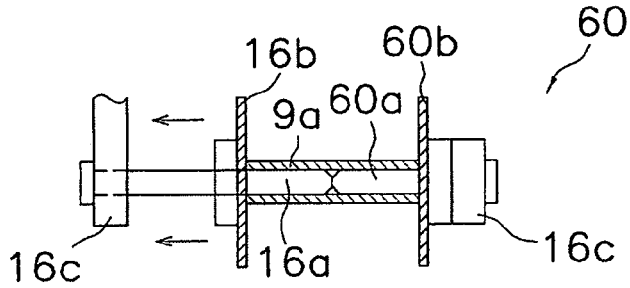

In this state, after the air chuck in the support unit 16 is released, the bracket 16*b* is moved relative to the first shaft 16*a* by the air cylinder 16*c* to the open-end side, as shown in FIG. 12C. The core 9*a* supported on the first shaft 16*a* can thereby be moved toward the temporary holding unit 60 with the second shaft 60*a*.

Figure 12D:
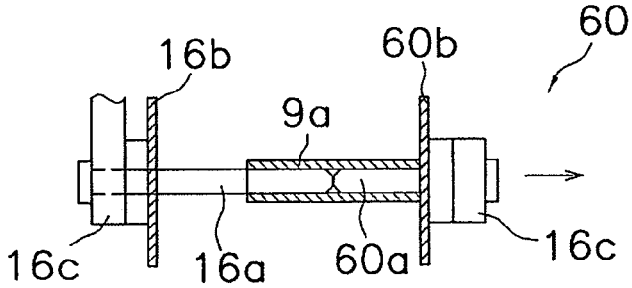
Figure 12E:
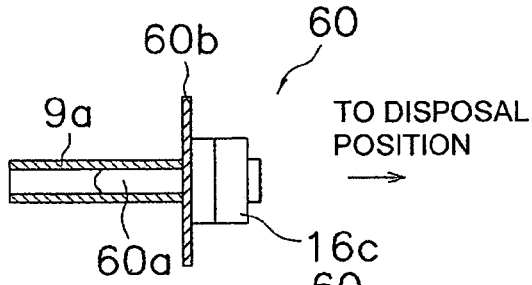

Next, in the state shown in FIG. 12D, the core 9*a* is air chucked in the second shaft 60*a*, and the core 9*a* is held onto the second shaft 60*a*. The temporary holding unit 60 is then moved to the disposal location 53 (see FIG. 8) shown in FIG. 12(*e*).

Figure 12F:
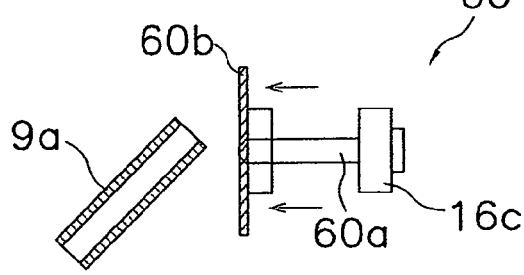

After the air chuck is released, the temporary holding unit 60 that has moved to the disposal location 53 moves the bracket 60*b* relative to the second shaft 60*a* by the air cylinder 60*c*, and disposes of the core 9*a* from the second shaft 60*a*, as shown in FIG. 12F.

As described above, by automatically discarding the core 9*a* using the support unit 16 and the temporary holding unit 60, it is possible to achieve even more automation in the bag manufacturing packaging system 50. As a result, production efficiency can be improved, production-line labor can be reduced, and reduction in load can be achieved.

<Characteristics of Present Bag Manufacturing Packaging Apparatus 3>

(1) In the bag manufacturing packaging apparatus 3 of the present embodiment, a film roll 9 that has been selected from among a plurality of film rolls 9 in the stocking unit 52 can be automatically loaded onto a cantilevered support unit 16 by using the temporary holding unit 60 that has the second shaft 60*a* that supports of the film roll 9 in a cantilever manner, as shown in FIGS. 10A through 11C. Specifically, first, the film roll 9 to be loaded is received by the temporary holding unit 60, and the temporary holding unit 60 is moved to a position where the second shaft 60*a* having one open end and the first shaft 16*a* the support unit 16 also having an open end are aligned opposite each other at the open ends. In this state, the bracket 60*b* of the temporary holding unit 60 is moved relative to the second shaft 60*a* to the open-end side described above by the air cylinder 60*c*. At this point, the film roll 9 is moved toward the first shaft 16*a* of the support unit 16 so as to be pushed out by the bracket 60*b*, and is transferred to the support unit 16.

The film roll 9 that has been selected by the second control unit 30 and conveyed to a location beside the bag manufacturing packaging apparatus 3 can thereby be loaded automatically onto the support unit 16 without the need for manual operation. As a result, the operation of loading heavy film rolls 9 is completely automated, whereby the load on the operator can be lightened, productivity can be improved, and production-line labor can be reduced.

(2) In the bag manufacturing packaging apparatus 3 of the present embodiment, as a movement mechanism for transferring the film roll 9 from the temporary holding unit 60 to the support unit 16, the temporary holding unit 60 has, as shown in FIGS. 10A through 11C, the bracket 60*b* that is movably mounted onto the second shaft 60*a*, and the air cylinder 60*c* that moves the bracket 60*b*.

The film roll 9 can thereby be transferred from the temporary holding unit 60 to the support unit 16 by using a simple configuration that combines the bracket 60*b*, which is a plate member, and the air cylinder 60*c*, which is a drive mechanism.

(3) In the bag manufacturing packaging apparatus 3 of the present embodiment, the temporary holding unit 60 that has passed the film roll 9 over to the first shaft 16*a* of the support unit 16 is returned to a standby position near the conveying apparatus 51 shown in FIG. 8.

The film roll 9 thus conveyed from the stocking unit 52 by the conveying apparatus 51 can thereby be immediately received and passed over to the support unit 16. As a result, production efficiency in the loading of the film roll 9 can be improved.

(4) The bag manufacturing packaging apparatus 3 of the present embodiment includes a core-removing mechanism (bracket 16*b*, air cylinder 16*c*) whereby the core 9*a* remaining on the first shaft 16*a* after the film F from the film roll 9 has been used up can be automatically removed from the first shaft 16*a*, as shown in FIGS. 12A through 12F.

The core 9*a* of the film roll 9 remaining on the first shaft 16*a* can thereby be automatically removed, and a new film roll 9 can be automatically loaded. Consequently, the removal of the core 9*a* that has previously been performed manually can be automated, and production efficiency can be further improved.

(5) In the bag manufacturing packaging apparatus 3 of the present embodiment, the core 9*a* remaining on the first shaft 16*a* is removed by the bracket 16*b* that moves relative to the first shaft 16*a* to the open-end side as the air cylinder 16*c* drives the bracket 16*b*, as shown in FIGS. 12A through 12F.

The core 9*a* can thereby be easily removed from the support unit 16 by using a simple configuration that combines the bracket 16*b*, which is a plate member, and the air cylinder 16*c*, which is a simple drive mechanism.

(6) In the bag manufacturing packaging apparatus 3 of the present embodiment, when only the core 9*a* of the film roll 9 remains supported on the first shaft 16*a*, the temporary holding unit 60 moves toward the support unit 16, as shown in FIGS. 12A through 12F. The second shaft 60*a* then is positioned opposite the first shaft 16*a* of the support unit 16, coaxially aligned on a straight line. The support unit 16 then drives the bracket 16*b* to the open-end side with the air cylinder 16*c*, and transfers the core 9*a* to the second shaft 60*a* of the temporary holding unit 60. The temporary holding unit 60 then coveys the received core 9*a* and discards the received core 9*a* at the disposal location 53.

The core 9*a* can thereby be reliably conveyed to the disposal location 53 by using the temporary holding unit 60. As a result, the occurrence of problems in which the cores 9*a* scatter within the bag manufacturing packaging system 50 can be avoided, and productivity can be improved.

(7) In the bag manufacturing packaging system 50 of the present embodiment, a single support unit 16 is provided for each bag manufacturing packaging apparatus 3 for supporting the film roll 9.

Production efficiency can herein be improved in the bag manufacturing packaging apparatus 3 of the present embodiment by automating the loading, replacement, core removal, and other such operations for the film roll 9 as described above. Therefore, decreases in productivity accompanying film roll replacement can be minimized even if a plurality of film rolls are not loaded as in known bag manufacturing packaging apparatuses. Consequently, even though the bag manufacturing packaging apparatus only supports a single film roll 9 at a time, the occurrence of problems in which productivity decreases during film roll replacement can be minimized, the size of the equipment can be reduced, and the configuration of the bag manufacturing packaging apparatus can be simplified.

(8) The bag manufacturing packaging apparatus 3 of the present embodiment includes a pawl portion 6*b* whose distal end portion is moved to a position near the film surface of the loaded film roll 9 as shown in FIGS. 4A through 4E and FIG. 5, so as to automatically pick up the end F1 of the film F from the film roll 9 loaded on the support unit 16.

In this manner, by rotating the loaded film roll 9 with the delivery motor 6*a*, the end F1 of the film F that is picked up by the distal end portion of the pawl portion 6*b* can be easily pulled out from the film roll 9. Consequently, it is possible to provide a bag manufacturing packaging apparatus 3 in which the picking up of the end F1 for the film roll 9 can be automated.

(9) The bag manufacturing packaging apparatus 3 of the present embodiment includes a conveyor belt 6*c* that conveys the end F1 of the film F, which has been picked up from the film roll 9 by the pawl portion 6*b* as described above, to the auto-splicer 6*d*, which is disposed on the downstream side, as shown in FIGS. 4E and 5.

The end F1 of the film F picked up from the film roll 9 can thereby be automatically conveyed to the auto-splicer 6*d*, and can be automatically joined with the film end of the previously loaded film roll. Consequently, the operation of the bag manufacturing packaging apparatus 3 can be initiated immediately after a new film roll 9 is loaded.

OTHER EMBODIMENTS

An embodiment of the present invention was described above, but the present invention is not limited to this embodiment, and various modifications can be made within a range that does not deviate from the scope of the invention.

(A) In the above embodiment, the bag manufacturing packaging apparatuses 3 of the bag manufacturing packaging system 50 each has a corresponding temporary holding unit 60, as shown in FIG. 8. However, the present invention is not limited to such structure.

For example, another possibility is to dispose a single temporary holding unit near the conveying apparatus of the bag manufacturing packaging system, and to perform automatic loading, automatic replacement, and core removal of the film rolls for all of the bag manufacturing packaging apparatuses of the bag manufacturing packaging system with the one temporary holding unit.

Still another possibility is to provide a plurality of temporary holding units per bag manufacturing packaging apparatus 3, and to design the bag manufacturing packaging apparatus 3 so that the film roll is replaced and loaded by one of the temporary holding units, and the core is removed by another. In this case, productivity can be further improved because the core can be removed while a new film roll is loaded.

(B) In the above embodiment, the second control unit 30 for controlling the entire bag manufacturing packaging system 50 controls the automatic loading, replacement, and core removal of the film rolls 9 via the first control unit 20 which controls each bag manufacturing packaging apparatus 3. However, the present invention is not limited to such structure.

For example, another possibility is for the second control unit to perform only the processes of selecting and conveying the film roll, and for the first control unit of respective bag manufacturing packaging apparatus to perform the automatic loading, replacement and core removal of the film roll.

(C) In the above embodiment, the brackets 16*b* and 60*b* in the support unit 16 and temporary holding unit 60 are moved by the air cylinders 16*c* and 60*c*. However, the present invention is not limited to such structure.

For example, the brackets of the support unit and temporary holding unit can be moved relative to the first and second shafts by using a ball screw or another such drive mechanism.

(D) In the above embodiment, the film roll 9 is selected giving priority, among similar film rolls, to ones with the oldest storage date, using the storage date data of the film rolls 9. If any film rolls have the same storage date, the selection is made giving priority to those with the least amount of remaining film. However, the present invention is not limited to such structure.

For example, another possibility is to select the film rolls giving priority to the remaining amount of film rather than the storage date first, or to use only one of these selection conditions.

(E) In the above embodiment, the core 9*a* remaining on the first shaft 16*a* after the film F of the film roll 9 has been used up is discarded, whereupon the core 9*a* is received by the temporary holding unit 60 and is conveyed to and discarded at a disposal location. However, the present invention is not limited to such structure.

For example, if a conveying apparatus for conveying the core to the disposal location or a waste disposal box is provided at the bottom of the support unit, the core need not be received by the temporary holding unit. The bracket of the support unit can be moved directly on the first shaft, and the core can be dropped off and discarded.

(F) In the above embodiment, the first control unit 20 for controlling each bag manufacturing packaging apparatus 3 and the second control unit 30 for controlling the bag manufacturing packaging system 50 are provided separately. However, the present invention is not limited to such structure.

For example, the first control unit and the second control unit may be combined into one control unit, which can control both the entire bag manufacturing packaging system and each of the bag manufacturing packaging apparatuses in the bag manufacturing packaging system.

(G) In the above embodiment, the bag manufacturing packaging system 50 includes five bag manufacturing packaging apparatuses 3, and the automatic replacement and automatic loading of the film rolls 9 are controlled for each bag manufacturing packaging apparatus 3. However, the present invention is not limited to the structure described above in terms of the number of bag manufacturing packaging apparatuses in the bag manufacturing packaging system.

For example, only one bag manufacturing packaging apparatus can be included in the bag manufacturing packaging system, or bag manufacturing packaging system can have ten or more bag manufacturing packaging apparatuses.

(H) In the above embodiment, a double-sided tape is used as the adhesive member 9*b* for temporarily fixing the end F1 of the film F of the film roll 9. When the end F1 is temporarily fixed to the underlying film surface with a double-sided tape that is disposed between the end F1 of the film and the underlying film surface, as in the embodiment described above, the end F1 can be slightly raised up from the film surface of the film roll 9. Thus, it is easy to pick up the end F1 of the pawl portion 6*b*. However, the present invention is not limited to such structure.

For example, a micro-suctions cup sheet having micro-suction cups on both sides may be used as the adhesive member. In this case, the end of the film can be temporarily fixed without leaving adhesive components on the surface of the film, unlike the case in which a double-sided tape or other such adhesive tape is used.

Figure 13:
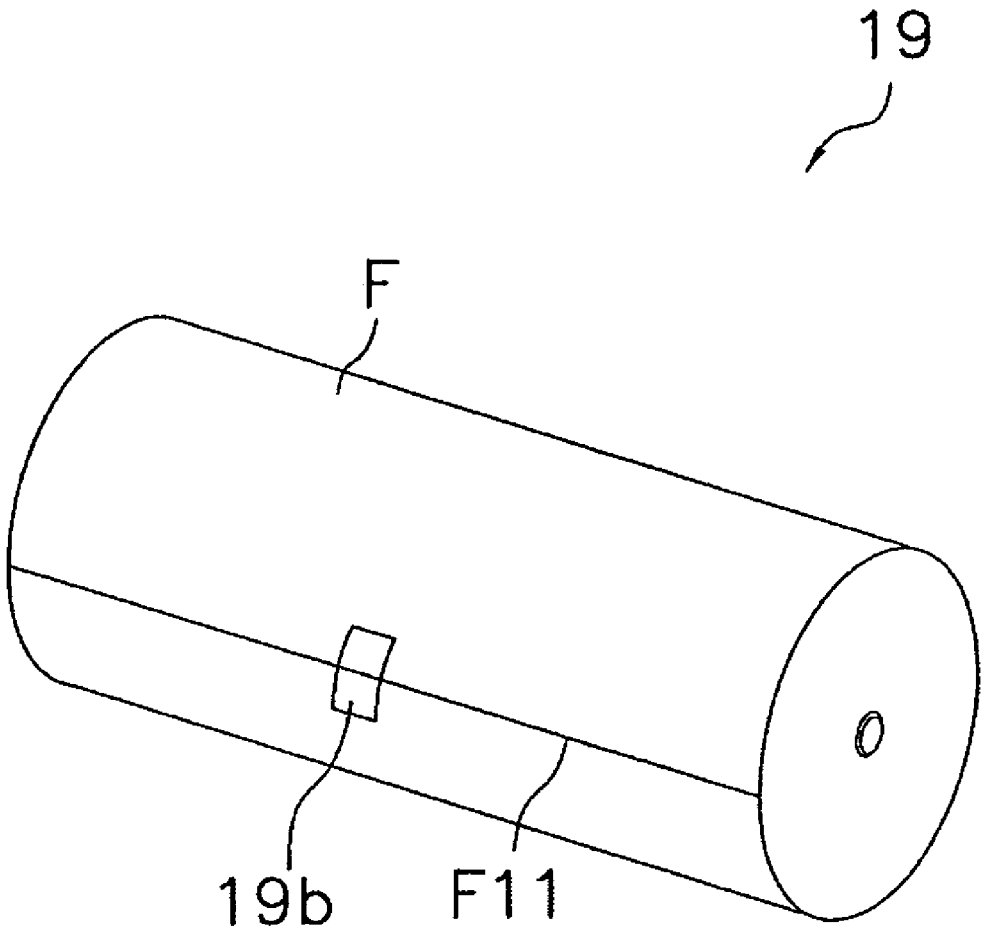
FIG. 13 is a perspective view showing a film roll loaded in a bag manufacturing packaging apparatus according to another embodiment.

Another possibility is a film roll 19 in which an adhesive tape 19*b* is affixed to the top of the end F11 from above as the adhesive member, as shown in FIG. 13.

(I) In the above embodiments, the film rolls 9 and 19, which are used for packaging bags, are automatically replaced as automatically replaceable rolls. However, the present invention is not limited to such structure.

For example, with the temporary holding unit of the embodiments of the present invention, the same effects as described above can be achieved with film rolls of other films such as film rolls of strip tape for attaching manufactured bags, film rolls of ribbons for printing, and so forth.

(J) In the above embodiment, the pawl portion 6*b*, the conveyor belt 6*c*, and other components shown in FIG. 5 are used as members for picking up the end F1 of the film F from the loaded film roll 9 and conveying the film F downstream. However, the present invention is not limited to such structure.

Figure 14:
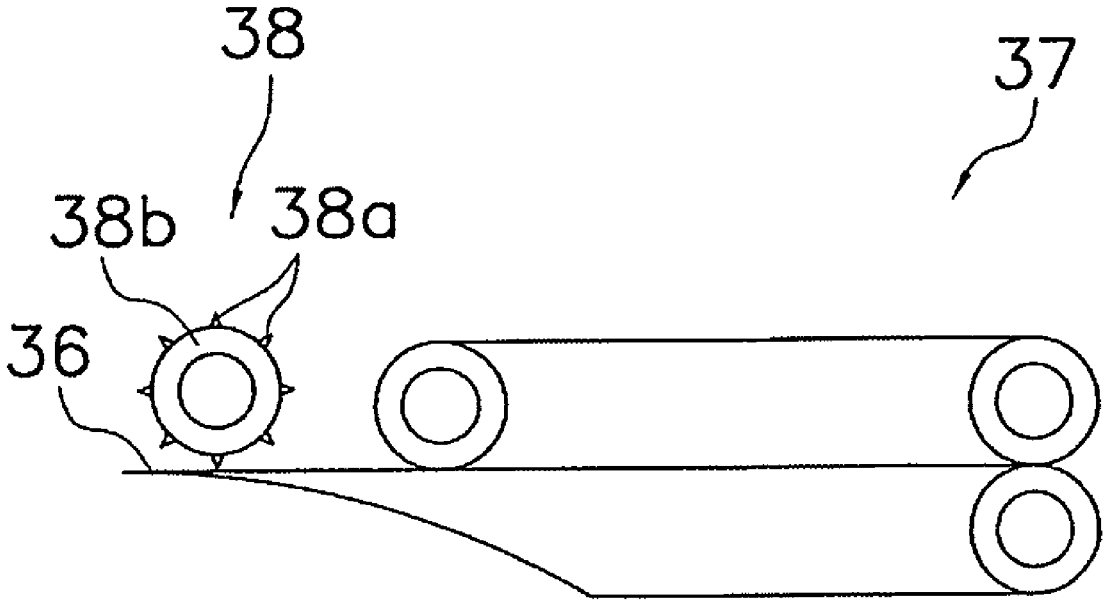
FIG. 14 is a diagram showing the configuration of the periphery of a pawl member for picking up the end of the film out from a film roll in a bag manufacturing packaging apparatus according to yet another embodiment.
Figure 15:
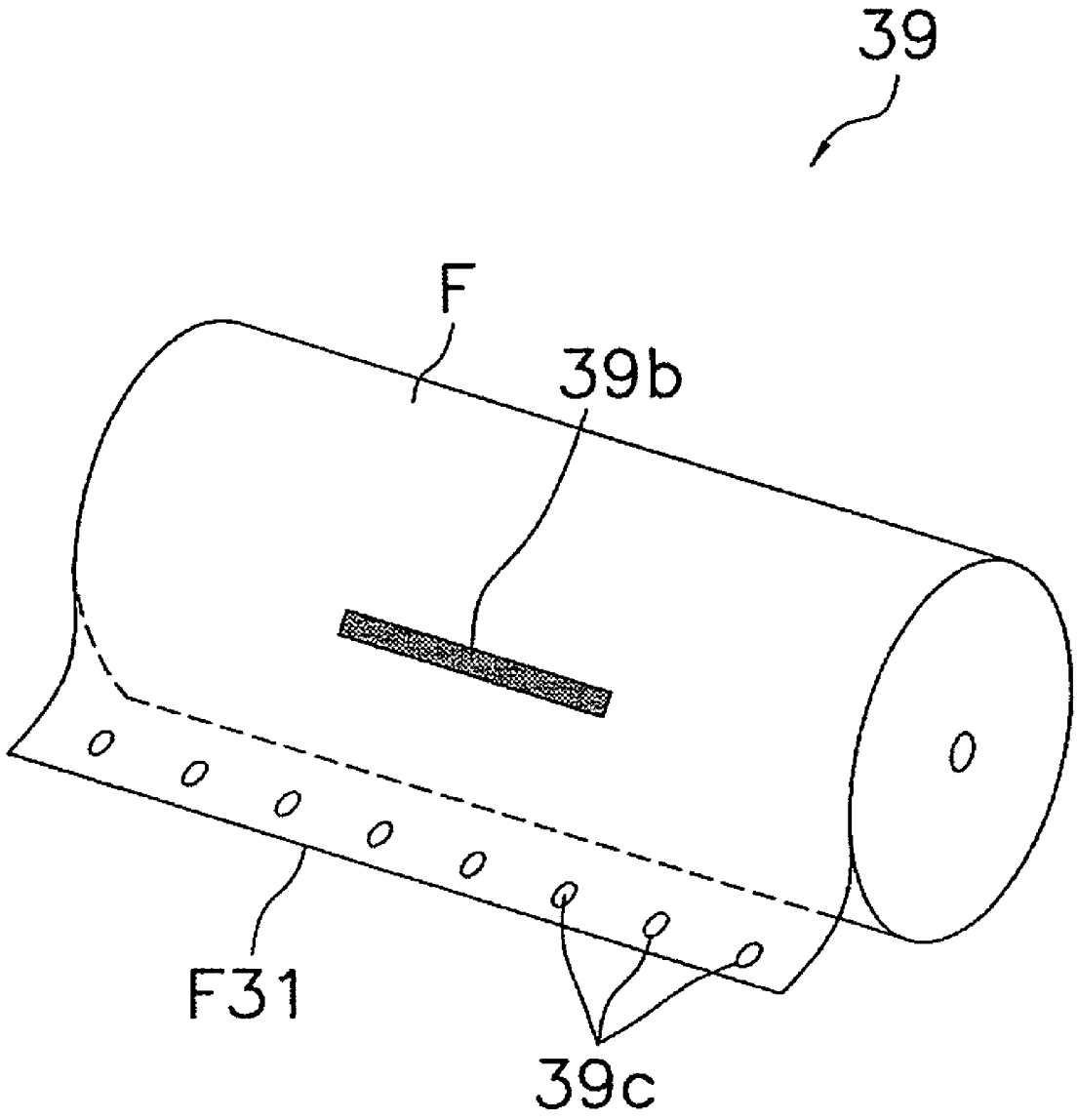
FIG. 15 is a perspective view showing the example of a film roll loaded into the bag manufacturing packaging apparatus shown in FIG. 14.

For example, another possibility is to dispose a conveying roller 38 near a pawl member 36, which is integrally formed as part of a conveyor belt 37, as shown in FIG. 14. The conveying roller 38 shown in FIG. 14 has projections 38*a* formed on the surface of a rotatably driven roller 38*b*, and is used, for example, to pick up the end F31 of a film F from a film roll 39 in which a plurality of holes 39*c* are formed in the end F31 of the film F. The end F31 of them film F temporarily fixed to the surface of the underlying film with an adhesive member 39*b*, as shown in FIG. 15.

Specifically, after the pawl member 36 is placed near the loaded film roll 39, the film roll 39 is rotated and the end F31 of the film F is picked up by the pawl member 36. The conveying roller 38 is then rotatably driven. At this time, the projections 38*a* on the conveying roller 38 engage the holes 39*c* that are formed in the portion of the end F31 on the film F, and accordingly convey the end F31 of the film F downstream. The end F31 of the film F picked up by the pawl member 36 can thereby be conveyed downstream smoothly.

The packaging apparatus of the present invention can automatically load and replace film rolls in an efficient manner, and therefore can be extensively applied to various apparatuses in which film rolls are loaded and replaced.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

This application claims priority to Japanese Patent Application No. 2005-015881. The entire disclosure of Japanese Patent Application No. 2005-015881 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A packaging apparatus comprising:

a support unit having a first cantilevered support shaft with an unsupported first open end portion and a supported first base portion, the first cantilevered support shaft being adapted to rotatably support a film roll;

a packaging unit operatively coupled to the support unit, and adapted to package items using a film of the film roll supported by the support unit; and a temporary holding unit having a second cantilevered support shaft that has an unsupported second open end portion and a supported second base portion, the second cantilevered support shaft being adapted to support the film roll, and a movement mechanism having a plate member movably mounted on the second cantilevered support shaft and a drive mechanism configured to controllably move the plate member toward and away from the second open end portion relative to the second cantilevered support shaft, the drive mechanism being configured to move the plate member to controllably pass the film roll from the second cantilevered support shaft to the first cantilevered support shaft so that the film roll is moved with respect to the second base end of the second cantilevered support shaft along an axial direction of the second cantilevered support shaft when the first open end portion of the first cantilevered support shaft and the second open end portion of the second cantilevered support shaft are substantially aligned.

2. The packaging apparatus according to claim 1, wherein the drive mechanism is configured to controllably move the plate member away from the second open end portion after the movement mechanism passes the film roll to the first cantilevered support shaft.

3. The packaging apparatus according to claim 1, wherein: the support unit further has a removing mechanism configured to controllably move the film roll toward the first open end portion relative to the first cantilevered support shaft.

4. The packaging apparatus according to claim 3, wherein the removing mechanism includes a plate member movably mounted to the first cantilevered support shaft, and a drive mechanism configured to controllably move the plate member toward and away from the first open end portion relative to the first cantilevered support shaft.

5. The packaging apparatus according to claim 4, wherein the first support shaft is adapted to controllably pass the film roll to the second cantilevered support shaft when the first open end portion of the first cantilevered support shaft and the second open end portion of the second cantilevered support shaft are substantially aligned.

6. The packaging apparatus according to claim 1, wherein the packaging apparatus has only one support unit.

7. The packaging apparatus according to claim 1, further comprising:

a pawl member that is configured to controllably move to a position adjacent to a surface of the film roll such that the pawl member engages and picks up an end of the film of the film roll supported by the first cantilevered support shaft.

8. The packaging apparatus according to claim 7, further comprising:

a film conveying unit configured to controllably convey the end of the film picked up from the film roll by the pawl member; and a splicer to which the film conveying unit conveys the end of the film, the splicer being configured to splice the end of the film of the film roll supported by the first cantilevered support shaft and an end of a film of another film roll.

9. A packaging system comprising:

a conveyance unit adapted to convey a film roll from a stocking location to a temporary loading location;

a packaging apparatus including a support unit having a first cantilevered support shaft with an unsupported first open end portion and a supported first base portion, the first cantilevered support shaft being adapted to rotatably support the film roll, a packaging unit operatively coupled to the support unit, and adapted to package items with a film of the film roll supported by the support unit, and a temporary holding unit having a second cantilevered support shaft that has an unsupported second open end portion and a supported second base portion, the second cantilevered support shaft being adapted to receive the film roll conveyed by the conveyance unit at the temporary loading location, and a movement mechanism having a plate member movably mounted on the second cantilevered support shaft and a drive mechanism configured to controllably move the plate member toward and away from the second open end portion relative to the second cantilevered support shaft, the drive mechanism being configured to move the plate member to controllably pass the film roll from the second cantilevered support shaft to the first cantilevered support shaft so that the film roll is moved with respect to the second base end of the second cantilevered support shaft along an axial direction of the second cantilevered support shaft when the first open end portion of the first cantilevered support shaft and the second open end portion of the second cantilevered support shaft are substantially aligned.

10. The packaging system according to claim 9, wherein the packaging system comprises a plurality of the packaging apparatuses that are operatively connected to one another.

11. The packaging system according to claim 9, wherein the drive mechanism is configured to controllably move the plate member away from the second open end portion after the movement mechanism passes the film roll to the first cantilevered support shaft.

12. The packaging system according to claim 9, wherein: the support unit further has a removing mechanism configured to controllably move the film roll toward the first open end portion relative to the first cantilevered support shaft.

13. The packaging system according to claim 12, wherein the removing mechanism includes a plate member movably mounted to the first cantilevered support shaft, and a drive mechanism configured to controllably move the plate member toward and away from the first open end portion relative to the first cantilevered support shaft.

14. The packaging system according to claim 13, wherein the first support shaft is adapted to controllably pass the film roll to the second cantilevered support shaft when the first open end portion of the first cantilevered support shaft and the second open end portion of the second cantilevered support shaft are substantially aligned.

15. The packaging system according to claim 9, wherein the packaging apparatus has only one support unit.

16. The packaging system according to claim 9, further comprising:

a pawl member that is configured to controllably move to a position adjacent to a surface of the film roll such that the pawl member engages and picks up an end of the film of the film roll supported by the first cantilevered support shaft.

17. The packaging system according to claim 16, further comprising:

a film conveying unit configured to controllably convey the end of the film picked up from the film roll by the pawl member; and a splicer to which the film conveying unit conveys the end of the film, the splicer being configured to splice the end of the film of the film roll supported by the first cantilevered support shaft and an end of a film of another film roll.

* * * * *